US011763755B2

(12) United States Patent
Kim et al.

(10) Patent No.: US 11,763,755 B2
(45) Date of Patent: Sep. 19, 2023

(54) LIGHT EMITTING DISPLAY DEVICE AND DRIVING METHOD OF THE SAME

(71) Applicant: LG Display Co., Ltd., Seoul (KR)

(72) Inventors: Hyuck Jun Kim, Goyang-si (KR); Tae Young Lee, Paju-si (KR); Ji Su Choi, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/734,381

(22) Filed: May 2, 2022

(65) Prior Publication Data

US 2022/0351689 A1 Nov. 3, 2022

(30) Foreign Application Priority Data

Apr. 30, 2021 (KR) ..... 10-2021-0056624

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2300/0809* (2013.01); *G09G 2310/0291* (2013.01); *G09G 2310/08* (2013.01); *G09G 2320/0238* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 2015/0279278 | A1 | 10/2015 | Park et al. | |
| 2017/0287429 | A1* | 10/2017 | Kong | G09G 3/3607 |
| 2017/0352305 | A1* | 12/2017 | Chang | G09G 3/2085 |
| 2019/0180693 | A1* | 6/2019 | Kim | G09G 3/3275 |
| 2020/0160781 | A1 | 5/2020 | Park | |
| 2021/0183299 | A1* | 6/2021 | Park | G09G 3/3225 |
| 2022/0208129 | A1* | 6/2022 | Yoo | G09G 3/3258 |

FOREIGN PATENT DOCUMENTS

| | | | | |
|---|---|---|---|---|
| KR | 10-2018-0059189 | A | | 6/2018 |
| KR | 10-2018-0065678 | A | | 6/2018 |
| KR | 20180059189 | A | * | 6/2018 |
| KR | 10-2067228 | B1 | | 1/2020 |
| KR | 20200069701 | A | * | 6/2020 |
| KR | 102363842 | B1 | * | 2/2022 |

* cited by examiner

*Primary Examiner* — Dorothy Harris
(74) *Attorney, Agent, or Firm* — Birch, Stewart, Kolasch & Birch, LLP

(57) ABSTRACT

A light emitting display (LED) device can include a display panel configured to display an image; and a data driver including a panel driving circuit configured to drive the display panel and a panel sensing circuit configured to sense a condition of the display panel, in which the panel driving circuit includes a first data voltage output circuit to output a voltage to both of a first data line and a first reference line of the display panel to display black on a first sub-pixel included in the display panel.

20 Claims, 23 Drawing Sheets

LIGHT EMITTING DISPLAY DEVICE AND DRIVING METHOD OF THE SAME

CROSS REFERENCE TO RELATED APPLICATIONS

This application claims the benefit of priority of patent application No. 10-2021-0056624, filed in the Republic of Korea on Apr. 30, 2021, the entirety of which is hereby incorporated by reference into this application.

BACKGROUND OF THE DISCLOSURE

Field of the Invention

The present invention relates to a light-emitting display (LED) device and a driving method thereof.

Discussion of the Related Art

With the development of information technology, the market for display devices is growing. Accordingly, display devices, such as an LED, a quantum dot display (QDD), and a liquid crystal display (LCD) have been increasingly used.

The above display devices each include a display panel including sub-pixels, a driver which outputs a driving signal for driving of the display panel, and a power supply which generates power to be supplied to the display panel or the driver.

In such a display device, when sub-pixels formed in a display panel are supplied with driving signals, for example, a scan signal and a data signal, a selected one thereof may transmit light therethrough or may directly emit light, thereby displaying an image. However, the displayed image may lack uniformity or have impaired gradation expression and lower image quality. Also, some display devices may be able to improve gradation, but do so at the expense of requiring the use of more data bits.

SUMMARY OF THE DISCLOSURE

Accordingly, the present invention is directed to an LED device and a driving method thereof that substantially obviates one or more problems due to limitations and disadvantages of the related art.

An object of the present invention is to individually vary a voltage applied to a pixel to express higher luminance, and to control a reference voltage as well as bits of data in units of bits (the same number of bits) to expand a gradation expression area.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an LED device includes a display panel configured to display an image, and a data driver including a panel driving circuit for driving the display panel and a panel sensing circuit for sensing the display panel, in which the panel driving circuit includes a first data voltage output circuit configured to output a voltage to be applied to a first data line and a first reference line of the display panel to display black on a first sub-pixel included in the display panel.

The first data voltage output circuit may be a circuit for driving the first sub-pixel not involved in image display among sub-pixels included in the display panel, and may output a voltage for displaying black instead of a data voltage necessary for image display during a data write period of the display panel.

A voltage output from the first data voltage output circuit may be shared by a switch, which is included in the data driver and electrically connects the first data line and the first reference line to each other.

The data driver may include switches configured to transmit a voltage output from a data voltage output circuit included in the panel driving circuit to a sensing channel together with a data channel during a data write period of the display panel.

The switches may include a first switching group configured to perform a switching operation to transmit a voltage output from the data voltage output circuit to the sensing channel, and a second switching group configured to perform a switching operation to output a voltage output from the data voltage output circuit through the data channel.

The data voltage output circuit may alternately output a first voltage and a second voltage having different levels during a data write period of the display panel, and at least one switch included in the first switching group may transmit the first voltage to the data channel and transmit the second voltage to the sensing channel.

The data driver may further include an output circuit disposed at an output terminal of the data voltage output circuit to alternately output a first voltage and a second voltage having different levels during a data write period of the display panel.

The output circuit may include an amplifier, a first voltage output switch configured to output a first voltage from a first voltage source, a second voltage output switch configured to output a second voltage from a second voltage source, an output capacitor charged with voltages output through the first voltage output switch and the second voltage output switch, and a third switching group configured to perform a switching operation to apply a voltage, with which the output capacitor is charged, to a non-inverting terminal of the amplifier.

The voltage for displaying black may be varied according to a state of an element included in the display panel.

In another aspect of the present invention, a driving method of an LED device including a display panel for displaying an image, and a data driver including a panel driving circuit for driving the display panel and a panel sensing circuit for sensing the display panel, includes applying a voltage to a first data line and a first reference line of the display panel to display black on a first sub-pixel included in the display panel, and applying a data voltage to a second data line to a fourth data line of the display panel to display an image on a second sub-pixel to a fourth sub-pixel included in the display panel.

It is to be understood that both the foregoing general description and the following detailed description of the present invention are explanatory examples and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain principles of the invention. In the drawings.

DETAILED DESCRIPTION OF THE DISCLOSURE

Reference will now be made in detail to the preferred embodiments of the present invention, examples of which are illustrated in the accompanying drawings. Wherever possible, the same reference numbers will be used throughout the drawings to refer to the same or like parts.

A display device according to the present invention can be implemented as a television, a video player, a personal computer (PC), a home theater, an automotive electric device, or a smartphone, but is not limited thereto. The display device according to the present invention can be implemented as an LED, a QDD, or an LCD. For convenience of description, an LED device that directly emits light based on an inorganic light-emitting diode or an organic light-emitting diode (OLED) will hereinafter be taken as an example of the display device according to the present invention.

Figure 1:
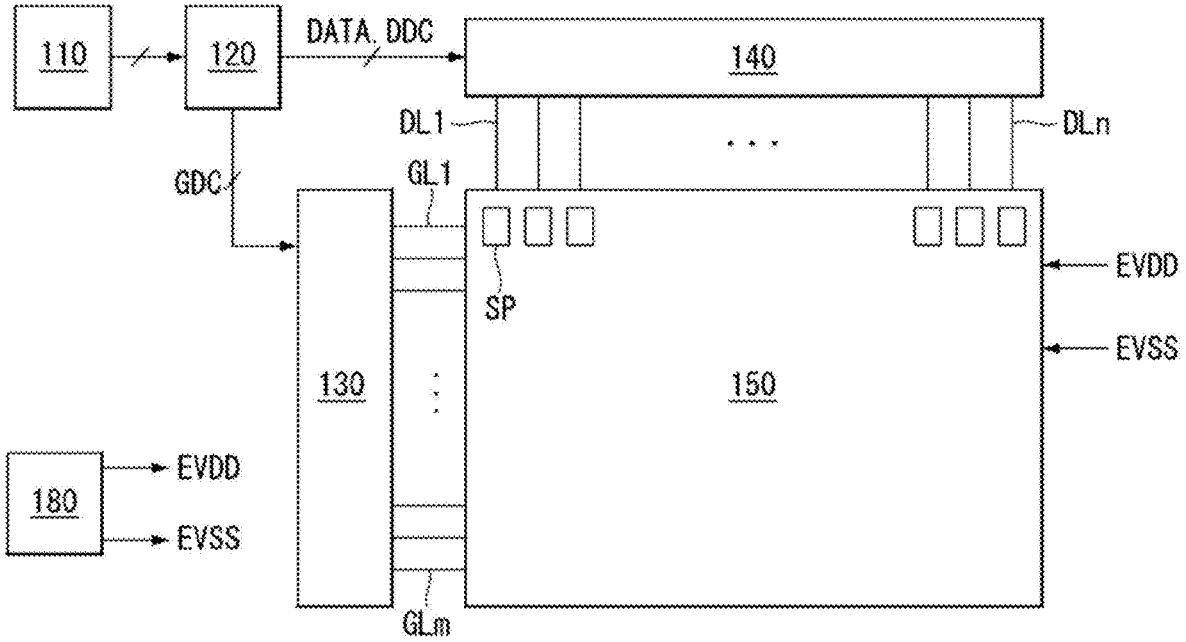
FIG. 1 is a block diagram schematically illustrating the configuration of an LED device, according to an embodiment of the present disclosure.
Figure 2:
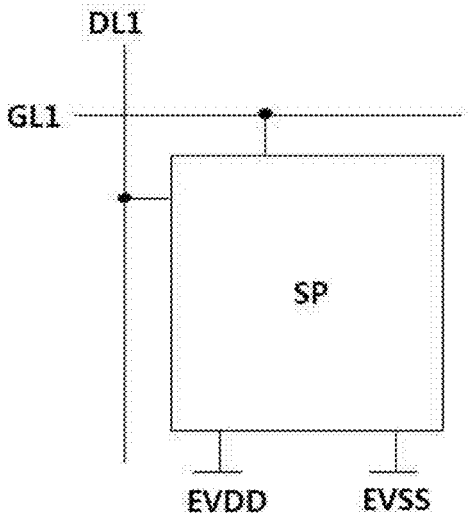
FIG. 2 is a schematic block diagram of a sub-pixel illustrated in FIG. 1 according to an embodiment of the present disclosure.

FIG. 1 is a block diagram schematically illustrating the configuration of an LED device, and FIG. 2 is a schematic block diagram of a sub-pixel illustrated in FIG. 1.

As illustrated in FIGS. 1 and 2, the LED device can include an image supply 110 (e.g., host or source device), a timing controller 120, a scan driver 130 (e.g., gate driver), a data driver 140, a display panel 150, and a power supply 180.

The image supply (set or host system) 110 can output various driving signals together with an image data signal externally supplied or an image data signal stored in an internal memory. The image supply 110 can supply the data signal and the various driving signals to the timing controller 120.

The timing controller 120 can output a gate timing control signal GDC for control of operation timing of the scan driver 130, a data timing control signal DDC for control of operation timing of the data driver 140, and various synchronization signals (a vertical synchronization signal Vsync and a horizontal synchronization signal Hsync). The timing controller 120 can supply a data signal DATA supplied from the image supply 110 together with the data timing control signal DDC to the data driver 140. The timing controller 120 can be formed in the form of an integrated circuit (IC) and mounted on a printed circuit board, but is not limited thereto.

The scan driver 130 can output a scan signal (or scan voltage) in response to the gate timing control signal GDC supplied from the timing controller 120. The scan driver 130 can supply the scan signal to sub-pixels included in the display panel 150 through gate lines GL1 to GLm. The scan driver 130 can be formed in the form of an IC or can be formed directly on the display panel 150 in a GIP manner, but is not limited thereto.

The data driver 140 can sample and latch the data signal DATA in response to the data timing control signal DDC supplied from the timing controller 120, convert the resulting digital data signal into an analog data voltage based on a gamma reference voltage, and output the converted analog data voltage. The data driver 140 can supply the data voltage to the sub-pixels included in the display panel 150 through data lines DL1 to DLn. The data driver 140 can be formed in the form of an IC and mounted on the display panel 150 or mounted on the printed circuit board, but is not limited thereto.

The power supply 180 can generate first power having a high potential and second power having a low potential based on an external input voltage externally supplied and output the generated first power and second power through a first power line EVDD and a second power line EVSS, respectively. The power supply 180 can generate and output a voltage (for example, a gate voltage including a gate high voltage and a gate low voltage) required to drive the scan driver 130 or a voltage (for example, a drain voltage including a drain voltage and a half-drain voltage) required to drive the data driver 140, as well as the first power and the second power.

The display panel 150 can display an image in response to a driving signal including the scan signal and the data voltage, the first power, and the second power. The sub-pixels of the display panel 150 directly emit light (e.g., no backlight needed). The display panel 150 can be manufactured based on a rigid or flexible substrate of glass, silicon, polyimide, etc. The sub-pixels which emit light can include red, green and blue sub-pixels or can include red, green, blue and white sub-pixels.

For example, one sub-pixel SP can be connected to a first data line DL1, a first gate line GL1, a first power line EVDD, and a second power line EVSS, and can include a pixel circuit which is composed of a switching transistor, a driving transistor, a capacitor, an organic light-emitting diode, etc. The sub-pixel SP used in the LED device directly emits light, and thus has a complex circuit configuration. Furthermore, there are various compensation circuits for compensating for deterioration of not only the organic light-emitting diode (OLED), which self-emits light, but also the driving transistor, which supplies driving current to the organic light-emitting diode. In this regard, it should be noted that the sub-pixel SP is simply illustrated in block form.

Meanwhile, the timing controller 120, the scan driver 130, the data driver 140, etc., have been described as having individual configurations. However, one or more of the timing controller 120, the scan driver 130 and the data driver 140 can be integrated into one IC depending on a method of implementation of the LED device.

Figure 3A:
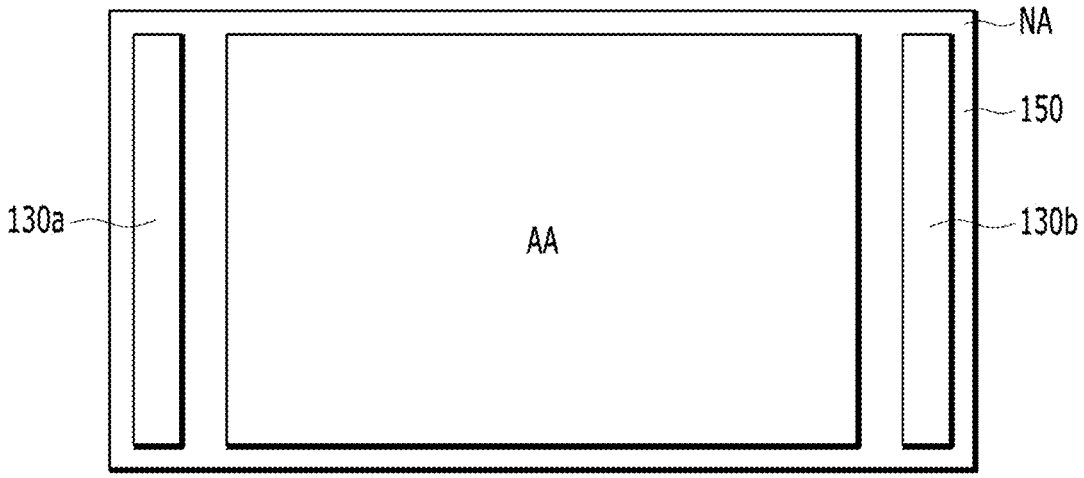
FIGS. 3A and 3B are views illustrating examples of the layout of a gate-in-panel (GIP)-type scan driver according to embodiments of the present disclosure.
Figure 3B:
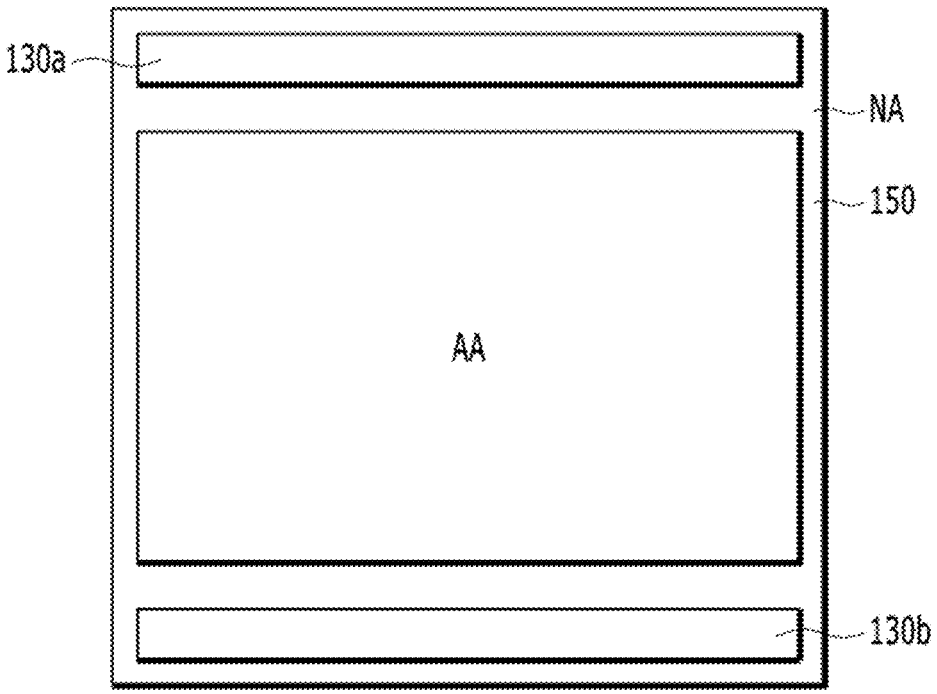
Figure 4:
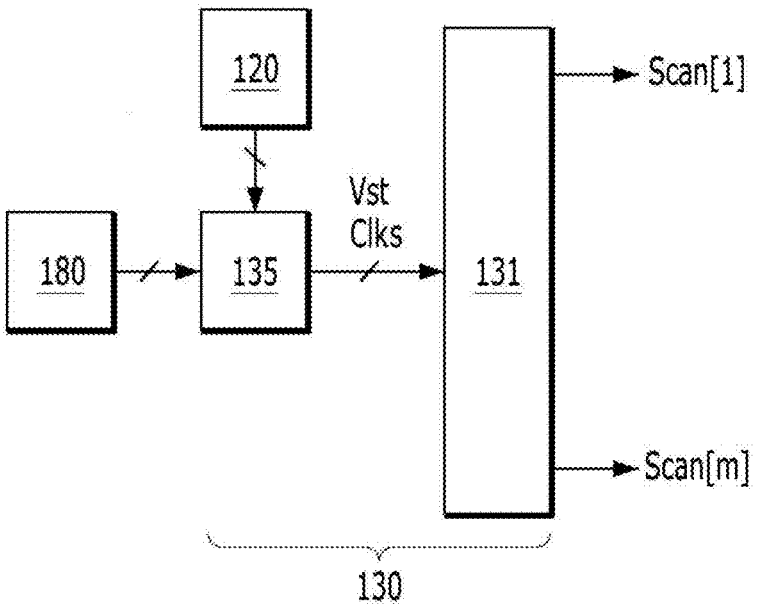
FIGS. 4 and 5 are block diagrams illustrating examples of the configurations of devices associated with the GIP-type scan driver according to embodiments of the present disclosure.
Figure 5:
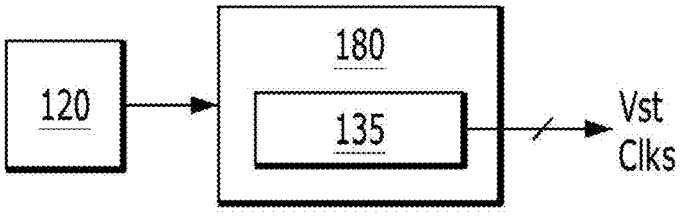

FIGS. 3A and 3B are views illustrating examples of the layout of a GIP-type scan driver, and FIGS. 4 and 5 are block diagrams illustrating examples of the configurations of devices associated with the GIP-type scan driver.

As illustrated in FIGS. 3A and 3B, GIP-type scan drivers 130*a* and 130*b* are disposed in a non-active area NA of the display panel 150. The scan drivers 130*a* and 130*b* can be disposed at the left and right parts of the non-active area NA of the display panel 150 as in FIG. 3A. Alternatively, the scan drivers 130*a* and 130*b* can be disposed at the upper and lower parts of the non-active area NA of the display panel 150 as in FIG. 3B.

Although the scan drivers 130*a* and 130*b* have been illustrated and disclosed as an example as being disposed in the non-display area NA on the left and right sides or the upper and lower sides of an display area AA, they can be disposed in the non-display area NA on only one of the left side, right side, upper side and lower side of the display area AA, or on three or the four sides of the display area AA.

As illustrated in FIG. 4, the GIP-type scan driver 130 can include a shift register 131 and a level shifter 135. The level shifter 135 can generate clock signals Clks and a start signal Vst based on signals and voltages output from the timing controller 120 and power supply 180. The clock signals Clks can be generated in the form of K different phases (where K is an integer which is greater than or equal to 2), such as two phases, four phases, and eight phases.

The shift register 131 can operate based on the signals Clks and Vst output from the level shifter 135 and output scan signals Scan[1] to Scan[m] capable of turning on or off transistors formed on the display panel. The shift register 131 can be formed on the display panel in the form of a thin film in a GIP manner. Therefore, the scan drivers 130*a* and 130*b* formed in the non-display area NA of the display panel 150 illustrated in FIGS. 3A and 3B can correspond to the shift register 131.

As illustrated in FIGS. 4 and 5, unlike the shift register 131, the level shifter 135 can be independently formed in the form of an IC or can be included in the power supply 180. However, this is merely one example, and the level shifter 135 is not limited thereto.

Figure 6:
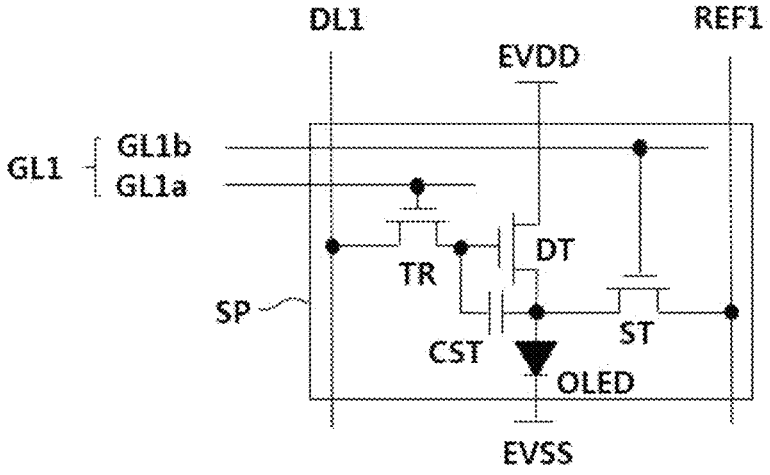
FIGS. 6 and 7 are diagrams of a sub-pixel with a compensation circuit according to an embodiment of the present disclosure.
Figure 7:
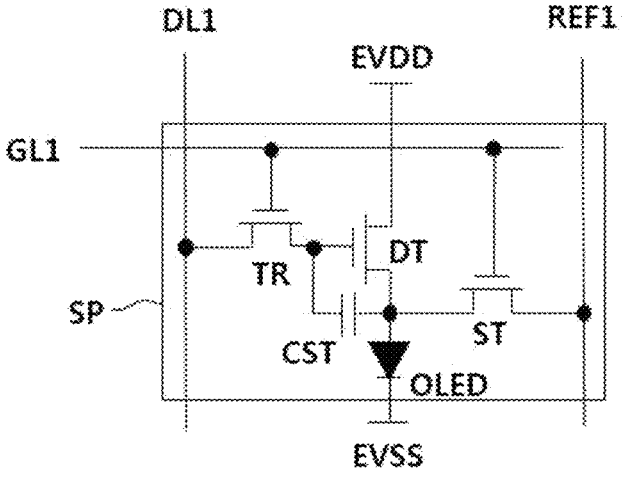
Figure 8:
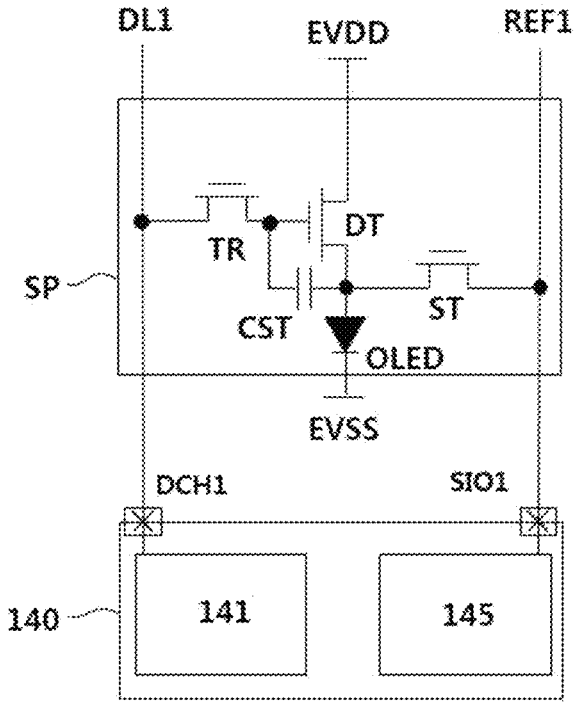
FIG. 8 is a schematic view of the sub-pixel of FIG. 6 or 7 and a data driver according to embodiments of the present disclosure.
Figure 9:
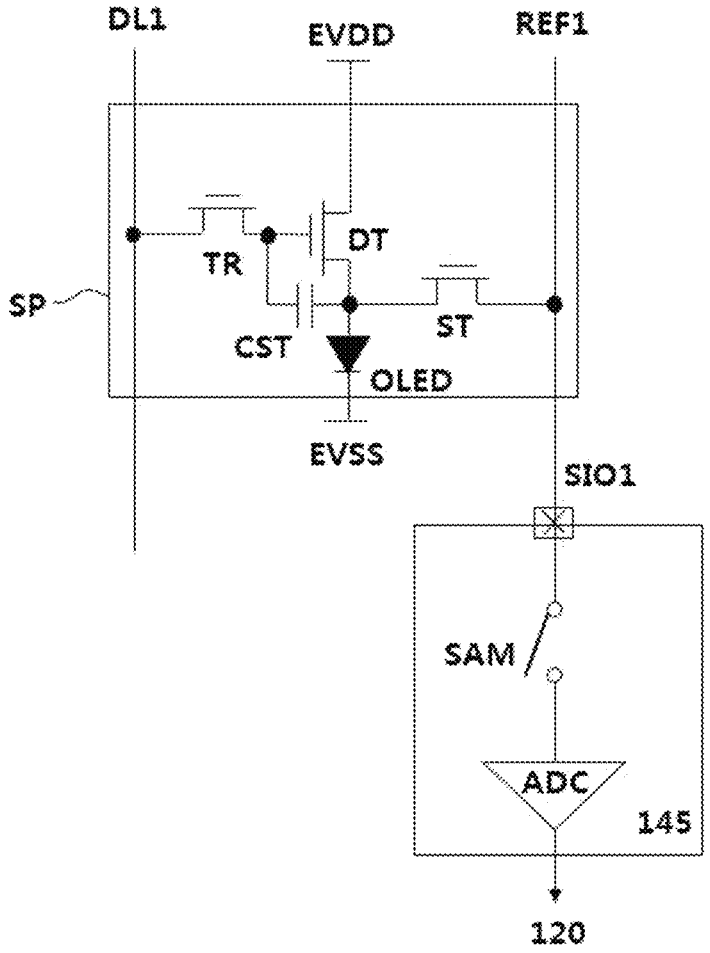
FIG. 9 is a detailed diagram of a panel sensing circuit illustrated in FIG. 8 according to an embodiment of the present disclosure.

FIGS. 6 and 7 are diagrams of a sub-pixel with a compensation circuit, FIG. 8 is a schematic view of the sub-pixel of FIG. 6 or 7 and a data driver, and FIG. 9 is a detailed diagram of a panel sensing circuit illustrated in FIG. 8.

As illustrated in FIG. 6, one sub-pixel SP can include a switching transistor TR, a driving transistor DT, a sensing transistor ST, a capacitor CST, and an organic light-emitting diode OLED.

The driving transistor DT can have a gate electrode connected to a first electrode of the capacitor CST, a first electrode connected to the first power line EVDD, and a second electrode connected to an anode electrode of the organic light-emitting diode OLED. The capacitor CST can have the first electrode connected to the gate electrode of the driving transistor DT and a second electrode connected to the anode electrode of the organic light-emitting diode OLED. The organic light-emitting diode OLED can have the anode electrode connected to the second electrode of the driving transistor DT and a cathode electrode connected to the second power line EVSS.

The switching transistor TR can have a gate electrode connected to a first-A gate line GL1*a* included in the first gate line GL1, a first electrode connected to the first data line DL1, and a second electrode connected to the gate electrode of the driving transistor DT. The switching transistor TR can be turned on in response to a scan signal transferred through the first-A gate line GL1*a*.

The sensing transistor ST can have a gate electrode connected to a first-B gate line GL1*b* included in the first gate line GL1, a first electrode connected to a first reference line REF1, and a second electrode connected to the anode electrode of the organic light-emitting diode OLED. The sensing transistor ST can be turned on in response to a sense signal transferred through the first-B gate line GL1*b*.

The sensing transistor ST is a kind of compensation circuit which is additionally provided to compensate for deterioration (e.g., in a threshold voltage, etc.) of the driving transistor DT or organic light-emitting diode OLED. The sensing transistor ST can enable physical threshold voltage sensing based on a source follower operation of the driving transistor DT. The sensing transistor ST can operate to acquire a sensed voltage through a sensing node defined between the driving transistor DT and the organic light-emitting diode OLED. The sensed voltage can be acquired during a sensing period of the display panel.

Meanwhile, although the first gate line GL1 can be divided into a first-A gate line GL1*a* and a first-B gate line GL1*b* as an example, the first-A gate line GL1*a* and the first-B gate line GL1*b* can be integrated into one line as illustrated in FIG. 7. That is, the switching transistor TR and the sensing transistor ST can be connected in common to the first gate line GL1 and be turned on or off at the same time.

As illustrated in FIG. 8, the data driver 140 can include a panel driving circuit 141 configured to drive the sub-pixel SP, and a panel sensing circuit 145 configured to sense the sub-pixel SP. The panel driving circuit 141 can be connected to the first data line DL1 through a first data channel DCH1 and the panel sensing circuit 145 may be connected to the first reference line REF1 through a first sensing channel SIO1. The panel driving circuit 141 can output a data voltage for driving of the sub-pixel SP through the first data channel DCH1. The panel sensing circuit 145 can acquire a sensed voltage from the sub-pixel SP through the first sensing channel SIO1.

As illustrated in FIG. 9, the panel sensing circuit 145 can include a sampling circuit SAM and an analog-to-digital converter ADC. The sampling circuit SAM and the analog-to-digital converter ADC can operate during the sensing period of the display panel.

The sampling circuit SAM can perform a sampling operation for acquiring the sensed voltage through the first reference line REF1. When the voltage or current reaches a specific condition (e.g., a sensing condition) after the sensing transistor ST included in the sub-pixel SP is turned on, the sampling circuit SAM can be turned on to acquire the voltage or current in a sampling method. The analog-to-digital converter ADC can convert the analog sensed voltage acquired by the sampling circuit SAM into a digital sensed voltage and output the converted voltage.

As stated above, the panel sensing circuit 145 can acquire a sensed voltage for compensation for deterioration of the driving transistor DT or organic light-emitting diode OLED included in the sub-pixel SP through the first reference line REF1 and output the acquired sensed voltage. The sensed voltage output from the panel sensing circuit 145 can be transferred to the timing controller 120. The timing controller 120 can determine whether the driving transistor DT or organic light-emitting diode OLED included in the sub-pixel SP has been deteriorated based on the sensed voltage, and perform a compensation operation for compensating for the deterioration.

Figure 10:
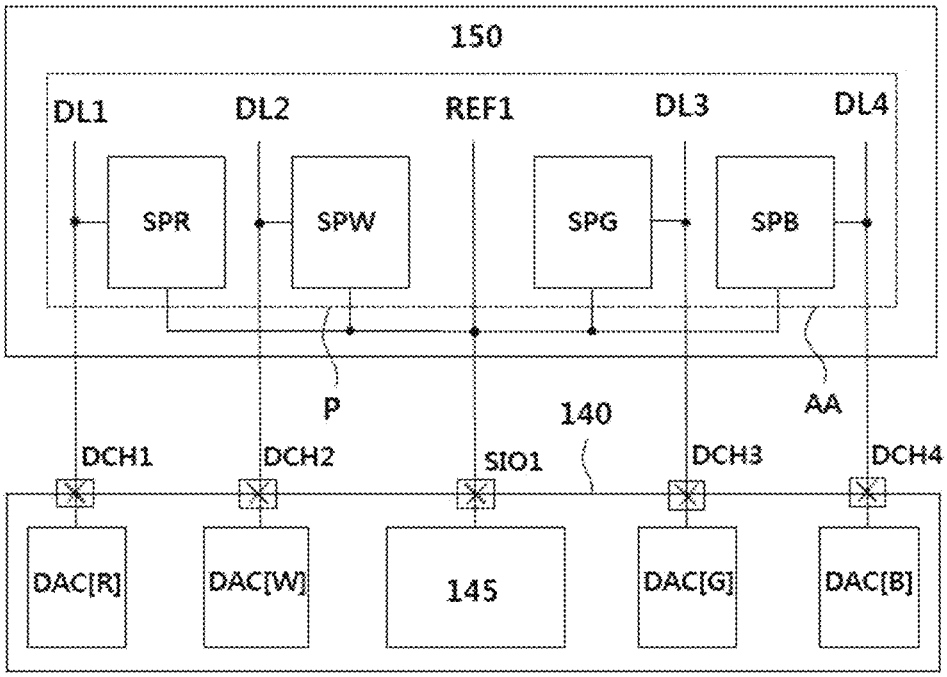
FIG. 10 is a block diagram of an LED device according to an embodiment of the present disclosure.

FIG. 10 is a block diagram of an LED device according to a first embodiment of the present invention, and FIGS. 11 to 14 are views illustrating a part of a sensing operation of the LED device according to the first embodiment of the present invention.

As illustrated in FIG. 10, a plurality of pixels can be disposed in the display area AA of the display panel 150. One pixel P can include a red sub-pixel SPR, a white sub-pixel SPW, a green sub-pixel SPG, and a blue sub-pixel SPB.

The red sub-pixel SPR, the white sub-pixel SPW, the green sub-pixel SPG and the blue sub-pixel SPB can be separately connected to the first data line DL1, the second data line DL2, the third data line DL3 and the fourth data line DL4, respectively. However, the red sub-pixel SPR, the white sub-pixel SPW, the green sub-pixel SPG and the blue sub-pixel SPB can be connected in common to the first reference line REF1 to share the first reference line REF1. That is, a total of four sub-pixels SPR, SPW, SPG and SPB included in one pixel P can have a structure connected to the panel sensing circuit 145 of the data driver 140 through one first reference line REF1 (e.g., a 4 sup-pixel to 1 reference line type of connection arrangement).

The data driver 140 can be connected to the display panel 150. The panel sensing circuit 145 of the data driver 140 can acquire a sensed voltage from a selected one of the red sub-pixel SPR, the white sub-pixel SPW, the green sub-pixel SPG, and the blue sub-pixel SPB through the first reference line REF1.

The panel driving circuit of the data driver 140 can include a red data voltage output unit (or circuit) DAC[R], a white data voltage output unit (or circuit) DAC[W], a green data voltage output unit (or circuit) DAC[G], and a blue data voltage output unit (or circuit) DAC[B]. The red data voltage output unit DAC[R], the white data voltage output unit DAC[W], the green data voltage output unit DAC[G], and the blue data voltage output unit DAC[B] can output data voltages during a data write period of the display panel 150.

The red data voltage output unit DAC[R] can output a red data voltage through the first data channel DCH1. The red data voltage can be applied to the red sub-pixel SPR connected to the first data line DL1. The white data voltage output unit DAC[W] can output a white data voltage through a second data channel DCH2. The white data voltage can be applied to the white sub-pixel SPW connected to the second data line DL2. The green data voltage output unit DAC[G] can output a green data voltage through a third data channel DCH3. The green data voltage can be applied to the green sub-pixel SPG connected to the third data line DL3. The blue data voltage output unit DAC[B] can output a blue data voltage through a fourth data channel DCH4. The blue data voltage can be applied to the blue sub-pixel SPB connected to the fourth data line DL4.

The red data voltage output unit DAC[R], the white data voltage output unit DAC[W], the green data voltage output unit DAC[G], and the blue data voltage output unit DAC[B] included in the panel driving circuit of the data driver 140 can output red, white, green, and blue data voltages, respectively, during a first image implementation period of the display panel 150. The red, white, green, and blue data voltages are voltages for putting the red, white, green, and blue sub-pixels in a light-emitting state (or a display state) during a display period of the display panel 150.

In addition, at least one of the red data voltage output unit DAC[R], the white data voltage output unit DAC[W], the green data voltage output unit DAC[G], and the blue data voltage output unit DAC[B] included in the panel driving circuit of the data driver 140 can output a black voltage instead of a red, white, green, or blue data voltage during a second image implementation period of the display panel 150. The black voltage is a voltage for putting a specific sub-pixel in a non-light-emitting state (e.g., a black display state or non-display state) during the display period of the display panel 150.

The first image implementation period can be defined as a period in which an image to be displayed on the display panel 150 is implemented in a high dynamic range (HDR), and the second image implementation period can be defined as a period in which an image to be displayed on the display panel 150 is implemented in a standard dynamic range (SDR).

As illustrated in FIGS. 11 to 14, at least one of the red data voltage output unit DAC[R], the white data voltage output unit DAC[W], the green data voltage output unit DAC[G], and the blue data voltage output unit DAC[B] included in the panel driving circuit of the data driver 140 can output a black voltage during a data write period included in the second image implementation period.

Except for the data voltage output unit that outputs the black voltage, the remaining data voltage output units can output a data voltage for putting the corresponding sub-pixel in a light-emitting state (or a display state).

Figure 11:
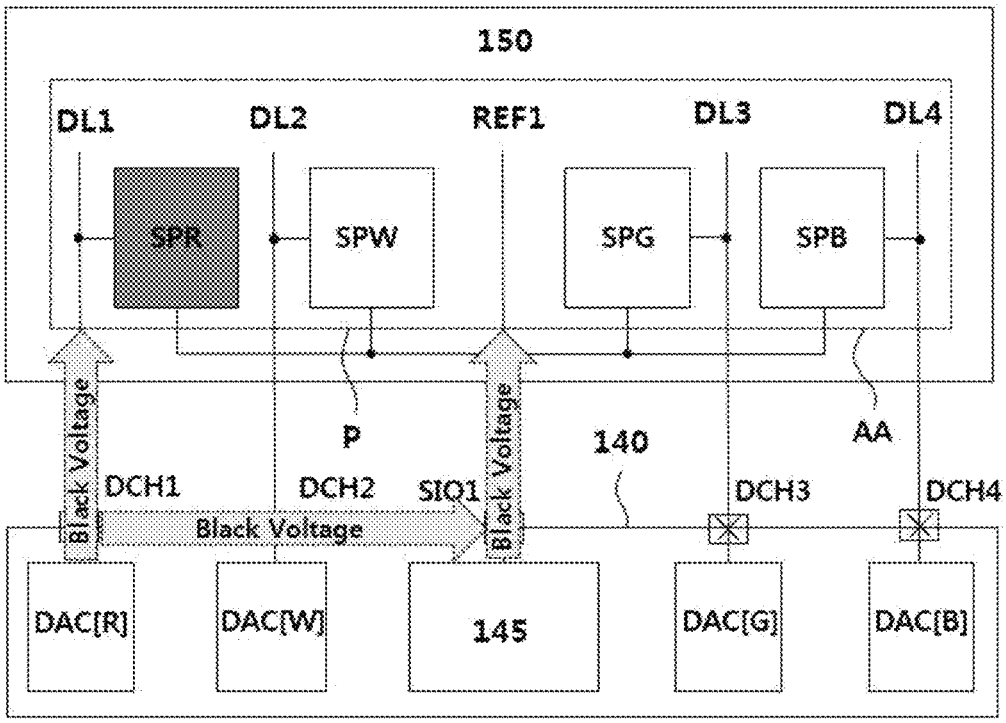
FIGS. 11 to 14 are views illustrating a part of a sensing operation of the LED device according to the LED device of FIG. 10.
Figure 12:
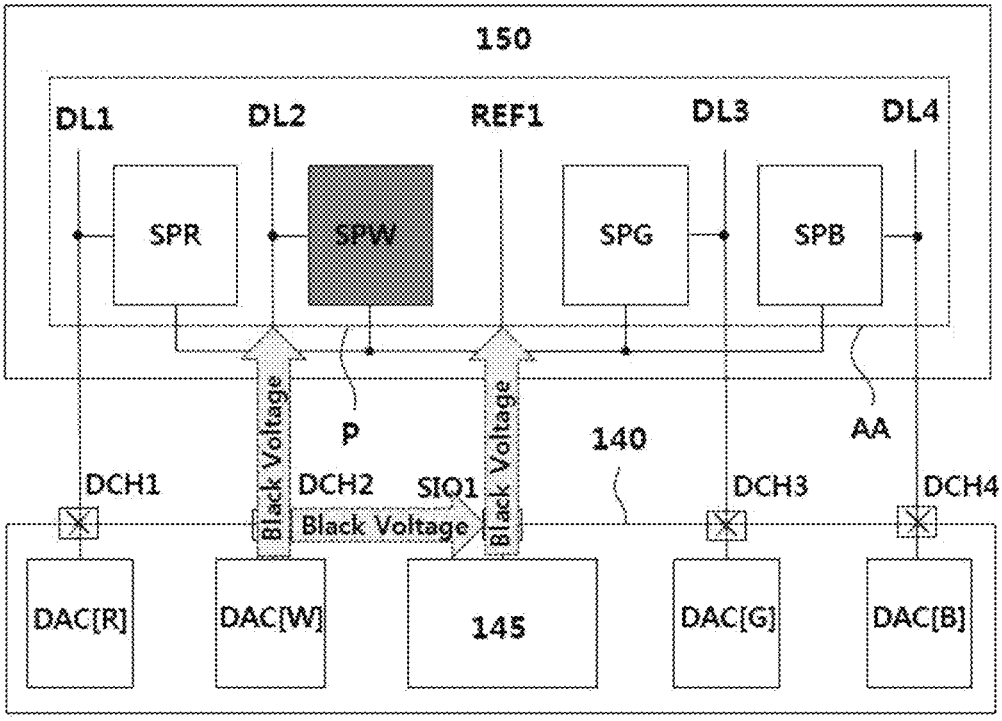
Figure 13:
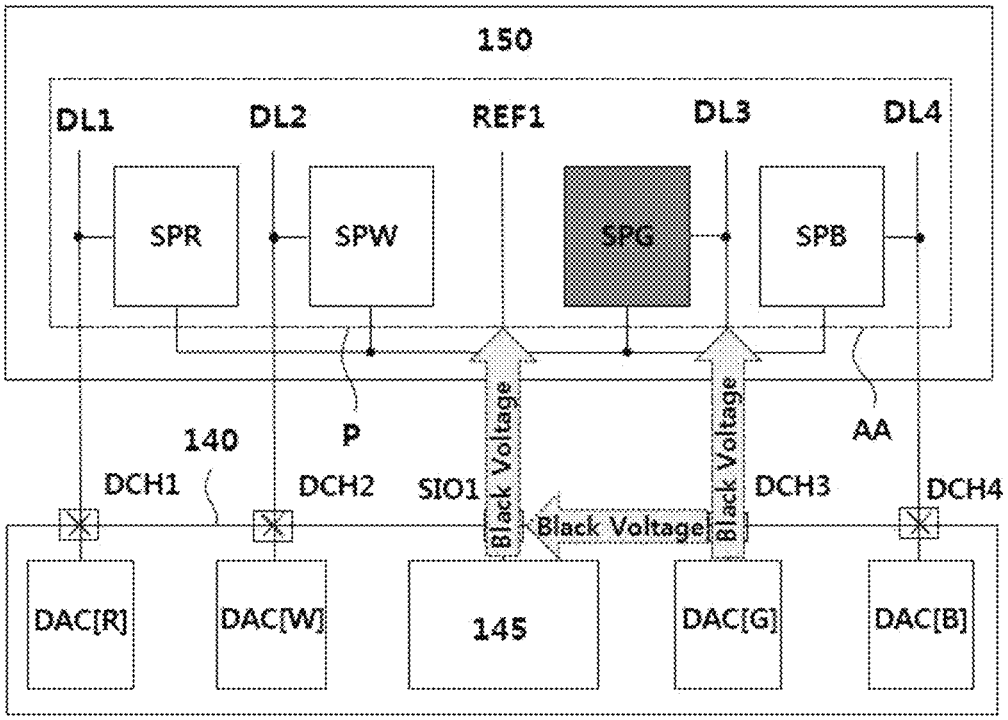
Figure 14:
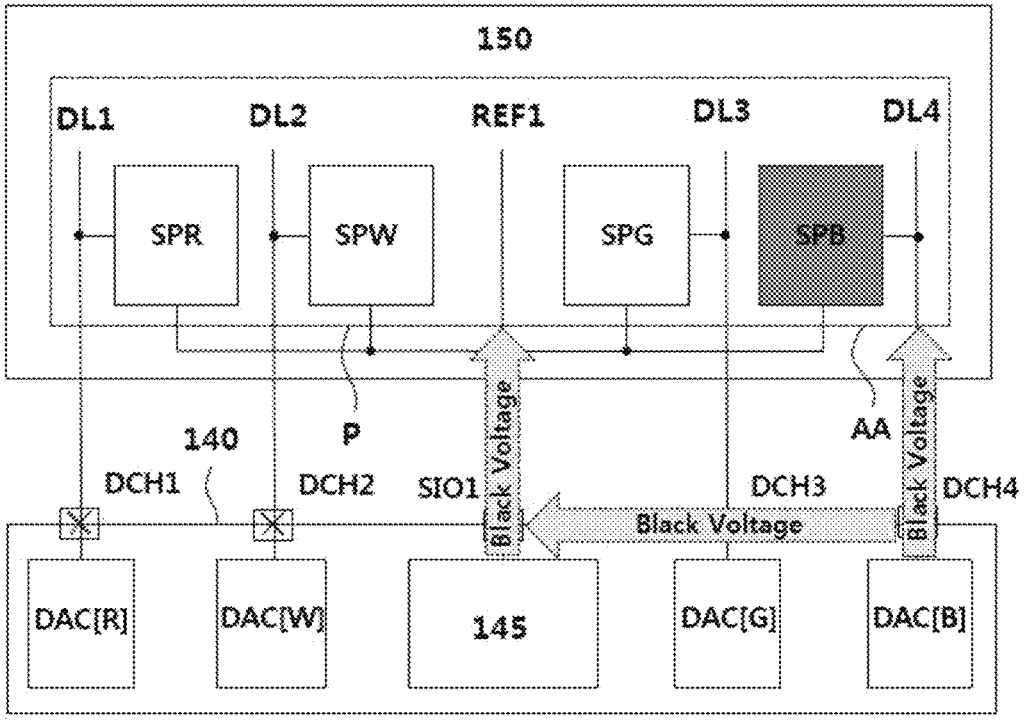

As illustrated in FIG. 11, the black voltage can be output from the red data voltage output unit DAC[R] and can be transmitted through both of the first data channel DCH1 and the first sensing channel SIO1. As illustrated in FIG. 12, the black voltage can be output from the white data voltage output unit DAC[W] and can be transmitted through both of the second data channel DCH2 and the first sensing channel SIO1. As illustrated in FIG. 13, the black voltage can be output from the green data voltage output unit DAC[G] and can be transmitted through both of the third data channel DCH3 and the first sensing channel SIO1. As illustrated in FIG. 14, the black voltage can be output from the blue data voltage output unit DAC[B] and can be transmitted through both of the fourth data channel DCH4 and the first sensing channel SIO1.

As can be seen from the above description, the black voltage is not applied from a separate voltage source provided inside or outside, and can be output from one of the data voltage output units DAC[R], DAC[W], DAC[G], and DAC[B] included in the panel driving circuit. In addition, the black voltage can be applied to different types of lines such that a voltage is shared (such that there are two output lines) as the data line and the reference line are electrically connected to each other.

As such, when a black voltage, which is a type of reference voltage, is applied using a data voltage output unit connected to a sub-pixel not used during the data write period included in the second image implementation period of the display panel 150, there is an advantage in that an internal circuit of the data driver 140 can be simplified (e.g., the number of lines needed in the pixel circuit can be reduced). In addition, there is an advantage in that the reference voltage can be individually controlled for each single sub-pixel within the pixel since the data voltage output unit is capable of changing the voltage that is used, thus providing a finer granularity of control. In addition, since a separate voltage source previously used can be removed, there is an advantage in that power consumption can be reduced due to removal/deletion of a configuration using a constant power source.

Hereinafter, a description will be given of a detailed configuration for outputting a black voltage using the data voltage output unit connected to the sub-pixel not used during the data write period included in the second image implementation period of the display panel 150. However, in the following description, parts specifically illustrated or changed compared to the first embodiment will be mainly described.

Figure 15:
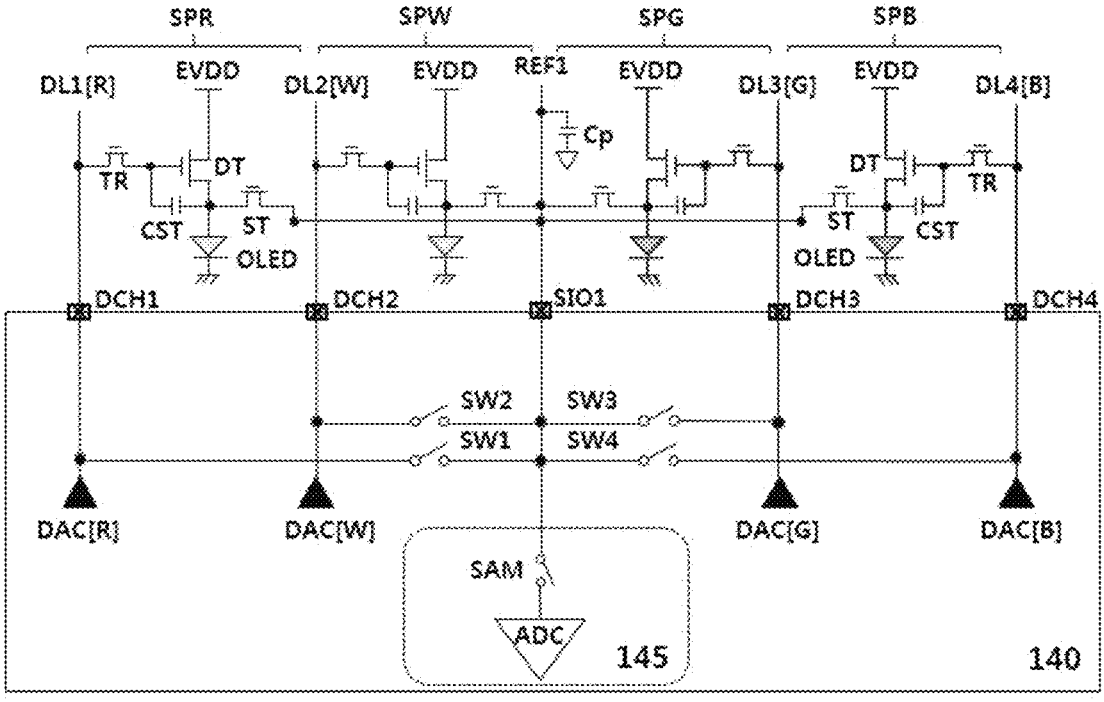
FIG. 15 is a circuit diagram of an LED device according to another embodiment of the present disclosure.
Figure 16:
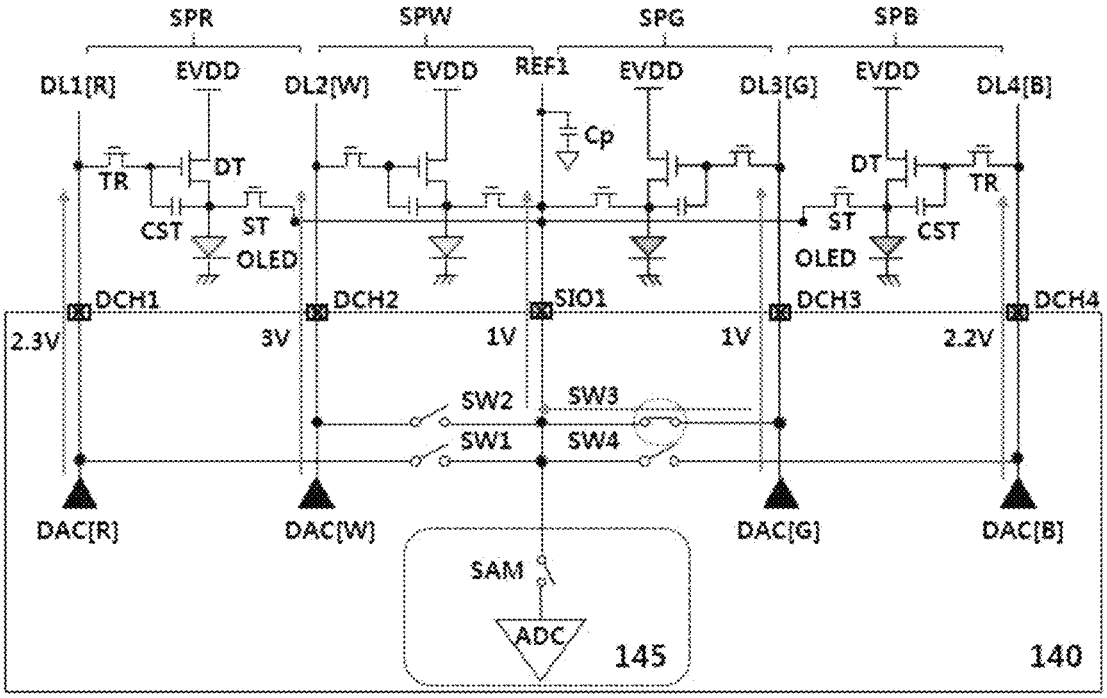
FIGS. 16 and 17 are views illustrating a part of a data write period of the LED device according to the LED device of FIG. 15.
Figure 17:
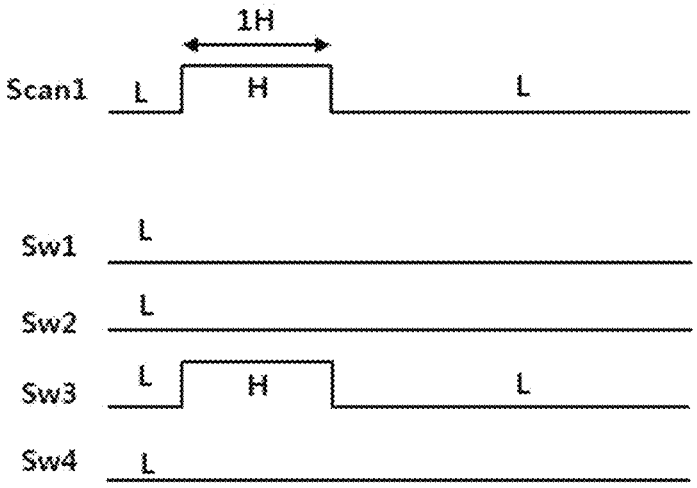

FIG. 15 is a circuit diagram of an LED device according to a second embodiment of the present invention, and FIGS. 16 and 17 are views illustrating a part of a data write period of the LED device according to the second embodiment of the present invention.

As illustrated in FIG. 15, the panel driving circuit of the data driver 140 can include data voltage output units DAC[R], DAC[W], DAC[G], and DAC[B] and a first switching group including switches SW1, SW2, SW3 and SW4.

The first switching group SW1 to SW4 can include first to fourth switches SW1 to SW4. The first to fourth switches SW1 to SW4 can serve to transmit a black voltage output from one of the data voltage output units DAC[R], DAC[W], DAC[G], and DAC[B] to a first reference line REF1 connected to a first sensing channel SIO1. Accordingly, one of the first to fourth switches SW1 to SW4 can be turned on during a data write period of a display panel.

The first switch SW1 can have a first electrode connected to the red data voltage output unit DAC[R], a second electrode connected to the first sensing channel SIO1, and a control electrode connected to a first control line to which a first switch control signal is transmitted. The second switch SW2 can have a first electrode connected to the white data voltage output unit DAC[W], a second electrode connected to the first sensing channel SIO1, and a control electrode connected to a second control line to which a second switch control signal is transmitted. The third switch SW3 can have a first electrode connected to the green data voltage output unit DAC[G], a second electrode connected to the first sensing channel SIO1, and a control electrode connected to a third control line to which a third switch control signal is transmitted. The fourth switch SW4 can have a first electrode connected to the blue data voltage output unit DAC[B], a second electrode connected to the first sensing channel SIO1, and a control electrode connected to a fourth control line to which a fourth switch control signal is transmitted.

Hereinafter, a driving method of the second embodiment and a part of a device operation according to the driving method will be illustrated and described using an example in which the green data voltage output unit DAC[G] is used as a circuit for outputting a black voltage. That is, in this example, it is assumed that a green sub-pixel SPG and the green data voltage output unit DAC[G] are driven to display only a black gradation without participating in the image display of the display panel. Also, since the sub-pixels are self-emitting (e.g., OLEDs), each sub-pixel is capable of presented true black.

As illustrated in FIGS. 16 and 17, during the data write period of the display panel, the red data voltage output unit DAC[R], the white data voltage output unit DAC[W], and the blue data voltage output unit DAC[B] can output 2.3 V, 3 V, and 2.2 V, respectively, as data voltages for expressing a specific gray level. The data voltages can be applied to sub-pixels SPR, SPW, and SPB for one horizontal time 1H when a first scan signal Scan1 is generated as logic high H.

When the red data voltage output unit DAC[R], the white data voltage output unit DAC[W], and the blue data voltage output unit DAC[B] output data voltages to express a specific gray level, the first switch SW1, the second switch SW2, and the fourth switch SW4 can be turned off. The first switch SW1, the second switch SW2, and the fourth switch SW4 can be kept turned off during a driving time including a time when the first scan signal Scan1 is generated as logic high H by the first switch control signal Sw1, the second switch control signal Sw2, and the fourth switch control signal Sw4 applied as logic low L.

During the data write period of the display panel, the green data voltage output unit DAC[G] can output 1 V as a black voltage for expressing a black gradation. However, other voltage levels can be used to correspond to true black, such as 0 V or a negative voltage level. When the green data voltage output unit DAC[G] outputs a black voltage for expressing a black gradation (e.g., true black), the third switch SW3 can be turned on. The third switch SW3 can be kept turned on for one horizontal time 1H in which the first scan signal Scan1 is generated as logic high H by the third switch control signal Sw3 applied as logic high H.

Referring to the above operation, the black voltage output from the green data voltage output unit DAC[G] can be transmitted to the third data line DL3 connected to the green sub-pixel SPG. As the third data channel DCH3 and the first sensing channel SIO1 are electrically connected to each other by the turned-on third switch SW3, the black voltage output from the green data voltage output unit DAC[G] can also be transmitted to the first reference line REF1 (e.g., the black voltage is supplied to both DL3 and REF1).

In this instance, the switching transistor TR and the sensing transistor ST included in the green sub-pixel SPG can be turned on by the first scan signal Scan1. Accordingly, the same voltage (Vg=Vs or Vgs=0) can be applied to the gate electrode (e.g., 1V) and the source electrode (e.g., 1V) of the driving transistor DT. As a result, the green sub-pixel SPG can display a black gradation.

Figure 18:
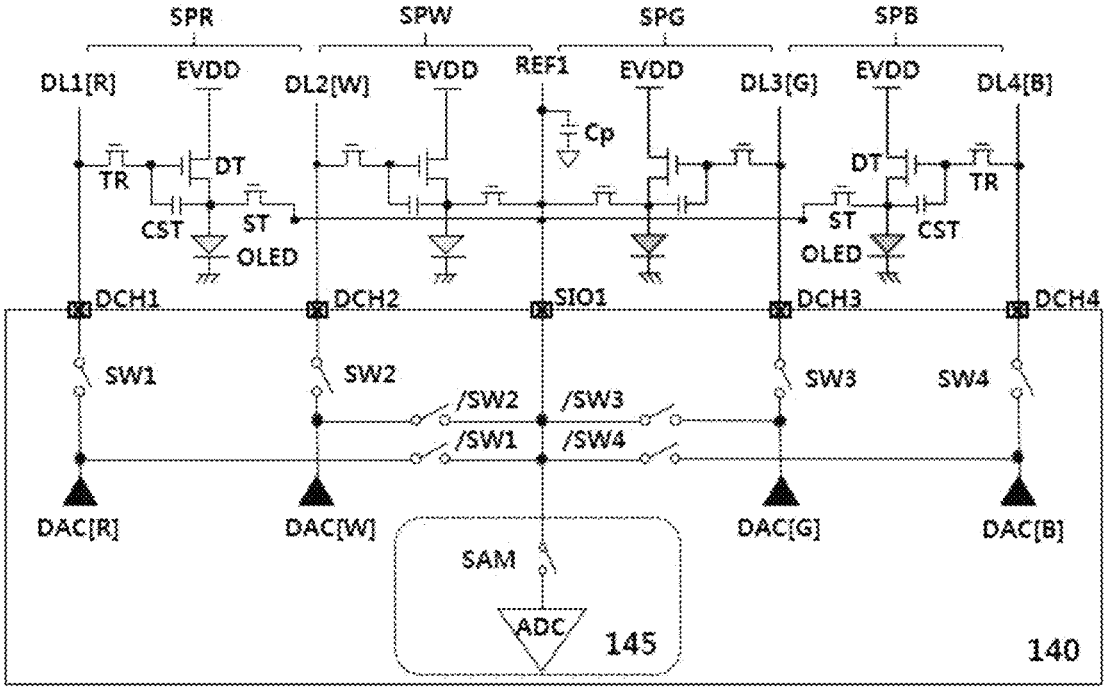
FIG. 18 is a circuit diagram of an LED device according to another embodiment of the present disclosure.
Figure 19:
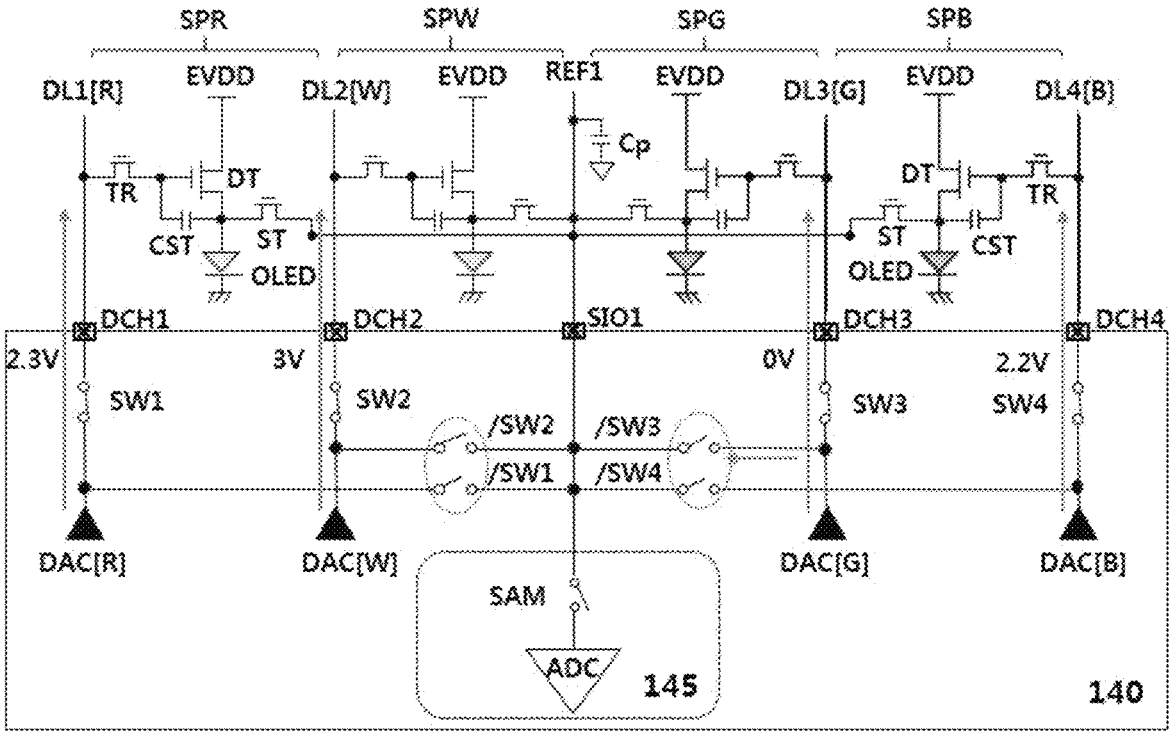
FIGS. 19 to 21 are views illustrating a part of a data write period of the LED device of FIG. 18.
Figure 20:
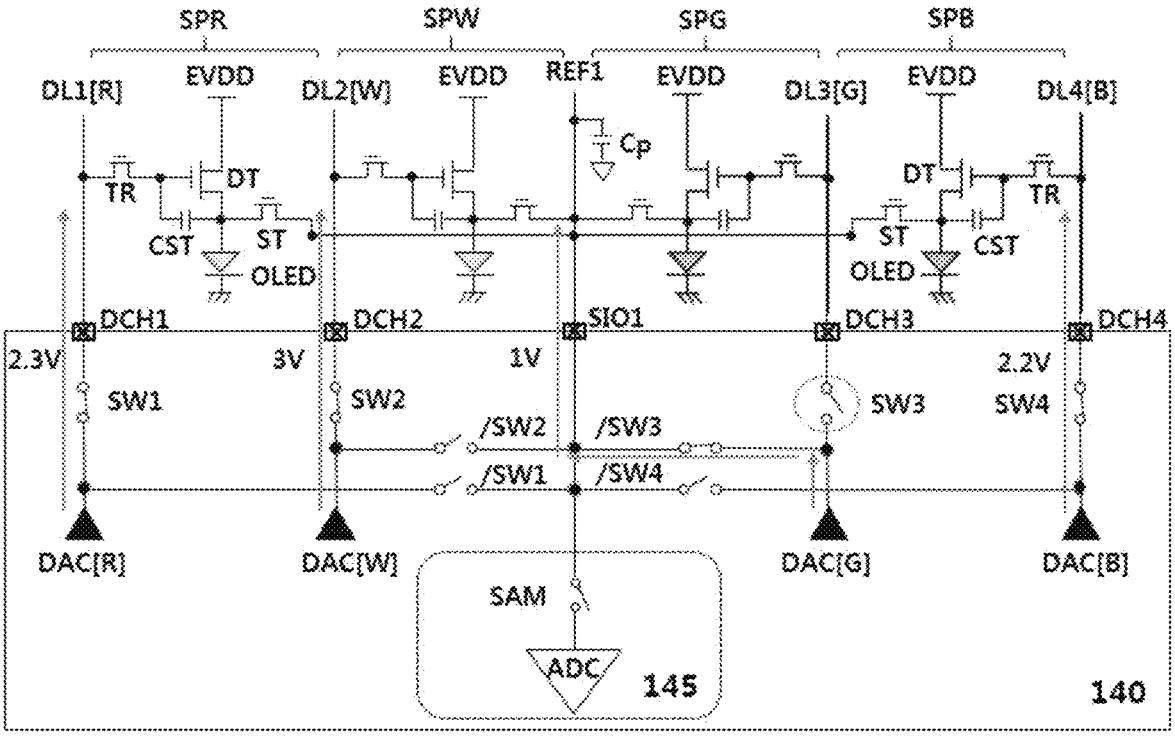
Figure 21:
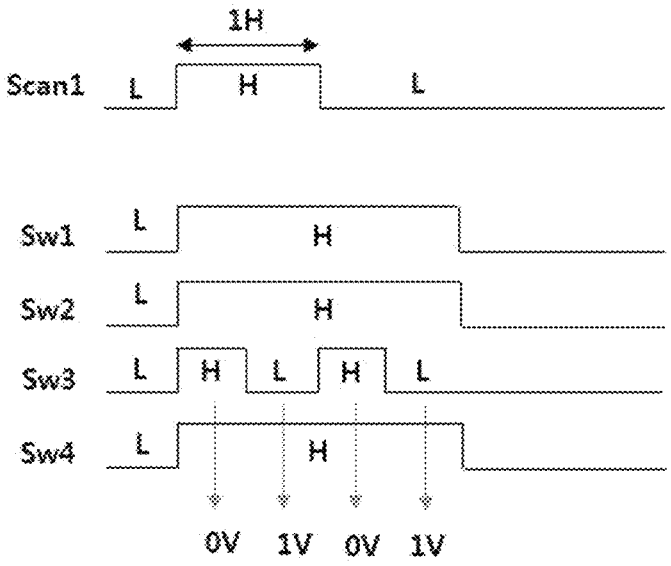

FIG. 18 is a circuit diagram of an LED device according to a third embodiment of the present invention, and FIGS. 19 to 21 are views illustrating a part of a data write period of the LED device according to the third embodiment of the present invention.

As illustrated in FIG. 18, the panel driving circuit of the data driver 140 can include data voltage output units DAC[R], DAC[W], DAC[G], and DAC[B], a first inverting switching group including switches /SW1, /SW2, /SW3 and /SW4, and a second switching group including SW1, SW2, SW3 and SW4. Alternatively, switches /SW1, /SW2, /SW3 and /SW4 can be referred to as a first switching group, and switches SW1, SW2, SW3 and SW4 can be referred to as a second switching group.

The first switching group /SW1 to /SW4 can include first to fourth inverting switches /SW1 to /SW4 and can be referred to as an inverting switching group. The first to fourth inverting switches /SW1 to /SW4 can serve to transmit a black voltage output from one of the data voltage output units DAC[R], DAC[W], DAC[G], and DAC[B] to the first reference line REF1 connected to the first sensing channel SIO1. Accordingly, one of the first to fourth inverting switches /SW1 to /SW4 can be turned on during a data write period of the display panel.

The first inverting switch /SW1 can have a first electrode connected to the red data voltage output unit DAC[R], a second electrode connected to the first sensing channel SIO1, and a control electrode connected to a first control line to which a first switch control signal is transmitted. The second inverting switch /SW2 can have a first electrode connected to the white data voltage output unit DAC[W], a second electrode connected to the first sensing channel SIO1, and a control electrode connected to a second control line to which a second switch control signal is transmitted. The third inverting switch /SW3 can have a first electrode connected to the green data voltage output unit DAC[G], a second electrode connected to the first sensing channel SIO1, and a control electrode connected to a third control line to which a third switch control signal is transmitted. The fourth inverting switch /SW4 can have a first electrode connected to the blue data voltage output unit DAC[B], a second electrode connected to the first sensing channel SIO1, and a control electrode connected to a fourth control line to which a fourth switch control signal is transmitted.

The second switching group SW1 to SW4 can include the first to fourth switches SW1 to SW4. The first to fourth switches SW1 to SW4 can serve to transmit data voltages or black voltages output from the data voltage output units DAC[R], DAC[W], DAC[G], and DAC[B] to data lines DL1 to DL4 connected to data channels DCH1 to DCH4, respectively. The first to fourth switches SW1 to SW4 can operate opposite to how the first to fourth inverted switches /SW1 to /SW4 operate. Accordingly, since the first to fourth switches SW1 to SW4 operate in an opposite manner relative to the first to fourth inverted switches /SW1 to /SW4, all but one of the first to fourth switches SW1 to SW4 can be turned on during the data write period of the display panel.

The first switch SW1 can have a first electrode connected to the red data voltage output unit DAC[R], a second electrode connected to the first data channel DCH1, and a control electrode connected to the first control line to which the first switch control signal is transmitted. The second switch SW2 can have a first electrode connected to the white data voltage output unit DAC[W], a second electrode connected to the second data channel DCH2, and a control electrode connected to the second control line to which the second switch control signal is transmitted. The third switch SW3 can have a first electrode connected to the green data voltage output unit DAC[G], a second electrode connected to the third data channel DCH3, and a control electrode connected to the third control line to which the third switch control signal is transmitted. The fourth switch SW4 can have a first electrode connected to the blue data voltage output unit DAC[B], a second electrode connected to the fourth data channel DCH4, and a control electrode connected to the fourth control line to which the fourth switch control signal is transmitted.

Hereinafter, a driving method of the third embodiment and a part of a device operation according to the driving method will be illustrated and described using an example in which the green data voltage output unit DAC[G] is used as a circuit for outputting a black voltage. That is, in this example, it is assumed that a green sub-pixel SPG and the green data voltage output unit DAC[G] are driven to display only a black gradation without participating in the image display of the display panel. For example, the green sup-pixel is placed in a black state (no light emitted), while the red, white and blue sup-pixels emit light according to respective gradation data voltage values for displaying an image.

As illustrated in FIGS. 19 to 21, during the data write period of the display panel, the red data voltage output unit DAC[R], the white data voltage output unit DAC[W], and the blue data voltage output unit DAC[B] can output 2.3 V, 3 V, and 2.2 V, respectively, as data voltages for expressing a specific gray level. The data voltages can be applied to sub-pixels SPR, SPW, and SPB for one horizontal time 1H when a first scan signal Scan1 is generated as logic high H.

When the red data voltage output unit DAC[R], the white data voltage output unit DAC[W], and the blue data voltage output unit DAC[B] output data voltages to express a specific gray level, the first inverting switch /SW1, the second inverting switch /SW2, and the fourth inverting switch /SW4 can be turned off. The first inverting switch /SW1, the second inverting switch /SW2, and the fourth inverting switch /SW4 can be kept turned off during a driving time including a time when the first scan signal Scan1 is generated as logic high H by the first switch control signal Sw1, the second switch control signal Sw2, and the fourth switch control signal Sw4 applied as logic high H.

During the data write period of the display panel, the green data voltage output unit DAC[G] can alternately output a first voltage (0 V) and a second voltage (1 V) as a black voltage for expressing a black gradation. When the green data voltage output unit DAC[G] varies and outputs the black voltage for expressing the black gradation, the third switch SW3 and the third inverting switch /SW3 can be alternately turned on/off so that the switches are in opposite on/off states.

The third switch SW3 and the third inverting switch /SW3 can be alternately turned on/off at least once so that the switches are in opposite on/off states for one horizontal time 1H in which the first scan signal Scan1 is generated as logic high H by the third switch control signal Sw3 alternately applied as logic high H and logic low L. Accordingly, when the third switch SW3 is turned on as illustrated in FIG. 19, the third inverting switch /SW3 can be turned off, and when the third switch SW3 is turned off as illustrated in FIG. 20, the third inverting switch /SW3 can be turned on.

Meanwhile, in order to accurately implement a black gradation, the third switch control signal Sw3 can be alternately applied as logic high H and logic low L at least once after one horizontal time 1H in which the first scan signal Scan is generated as logic high H. However, the present invention is not limited thereto.

With reference to the above operation, a black voltage of 0 V output from the green data voltage output unit DAC[G] can be transmitted to the third data line DL3 connected to the green sub-pixel SPG by the turned-on third switch SW3, and is not transmitted to the first reference line REF1 (e.g., see FIG. 19). In addition, a black voltage of 1 V output from the green data voltage output unit DAC[G] can be transmitted to the first reference line REF1 connected to the first sensing channel SIO1 by the turned-on third inverting switch /SW3, and not be transmitted to the third data line DL3 (e.g., see FIG. 20).

In this instance, the switching transistor TR and the sensing transistor ST included in the green sub-pixel SPG can be turned on by the first scan signal Scan1. Accordingly, different voltages (Vg<Vs or Vgs<0) can be applied to the gate electrode (0 V) and the source electrode (1 V) of the driving transistor DT. As a result, a lower voltage is applied to the third data line DL3 than to the first reference line REF1. Therefore, when the threshold voltage Vth of the driving transistor DT moves to a negative voltage range due to stress NBTiS, the green sub-pixel SPG can display a black gradation.

Meanwhile, in the above description, an example in which the green sub-pixel SPG connected to the green data voltage output unit DAC[G] displays a black gradation for at least two horizontal times is given, and thus a waveform for a switching operation of the third switch SW3 is illustrated and described to receive 0 V, 1 V, 0 V, and 1 V. Therefore, it should be noted that, when the green sub-pixel SPG connected to the green data voltage output unit DAC[G] displays a black gradation for one horizontal time 1H, the third switch SW3 performs a turn-on and turn-off operation only once.

Figure 22:
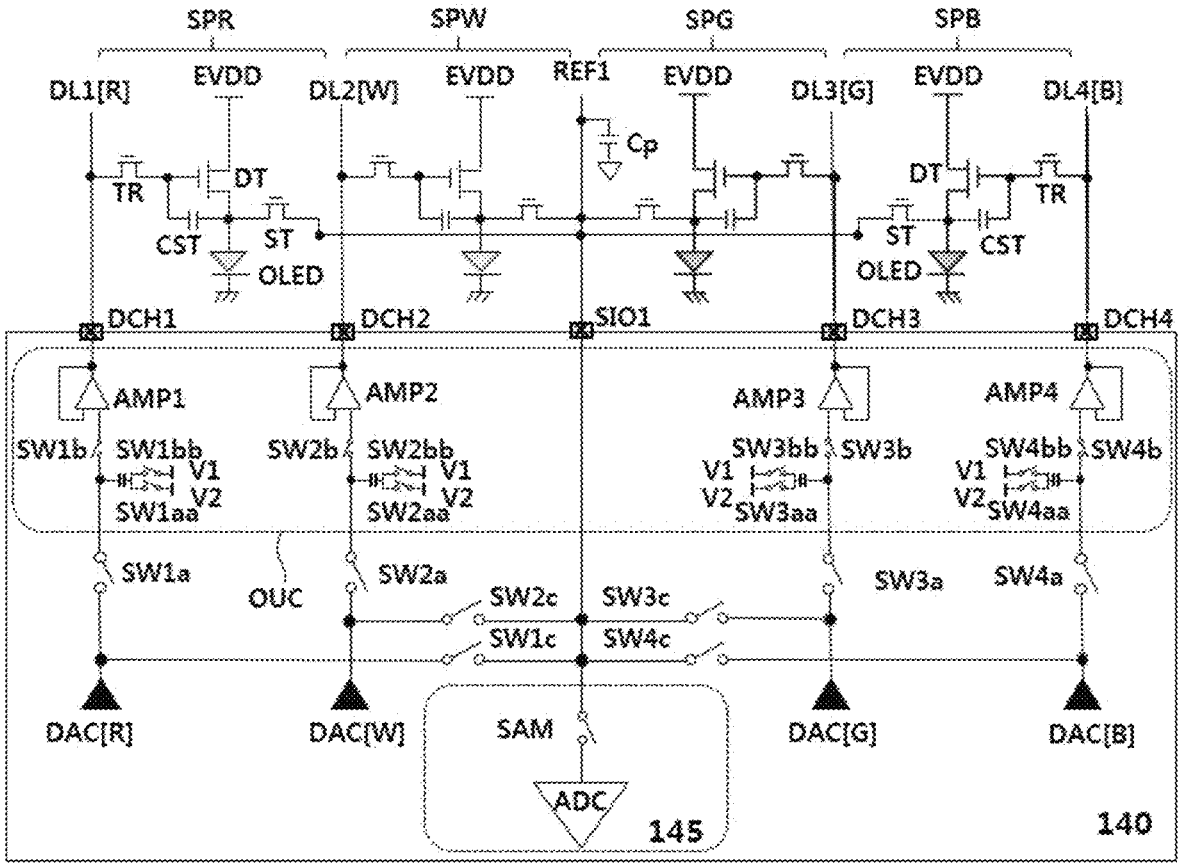
FIG. 22 is a circuit diagram of an LED device according to ANOTHER of the present disclosure.
Figure 23:
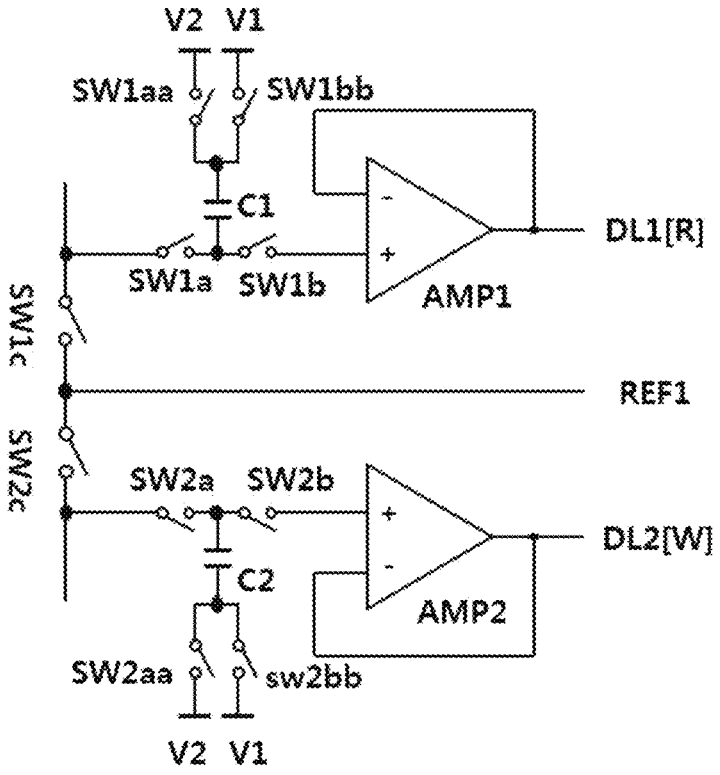
FIG. 23 is a detailed diagram of a part of a circuit illustrated in FIG. 22.
Figure 24:
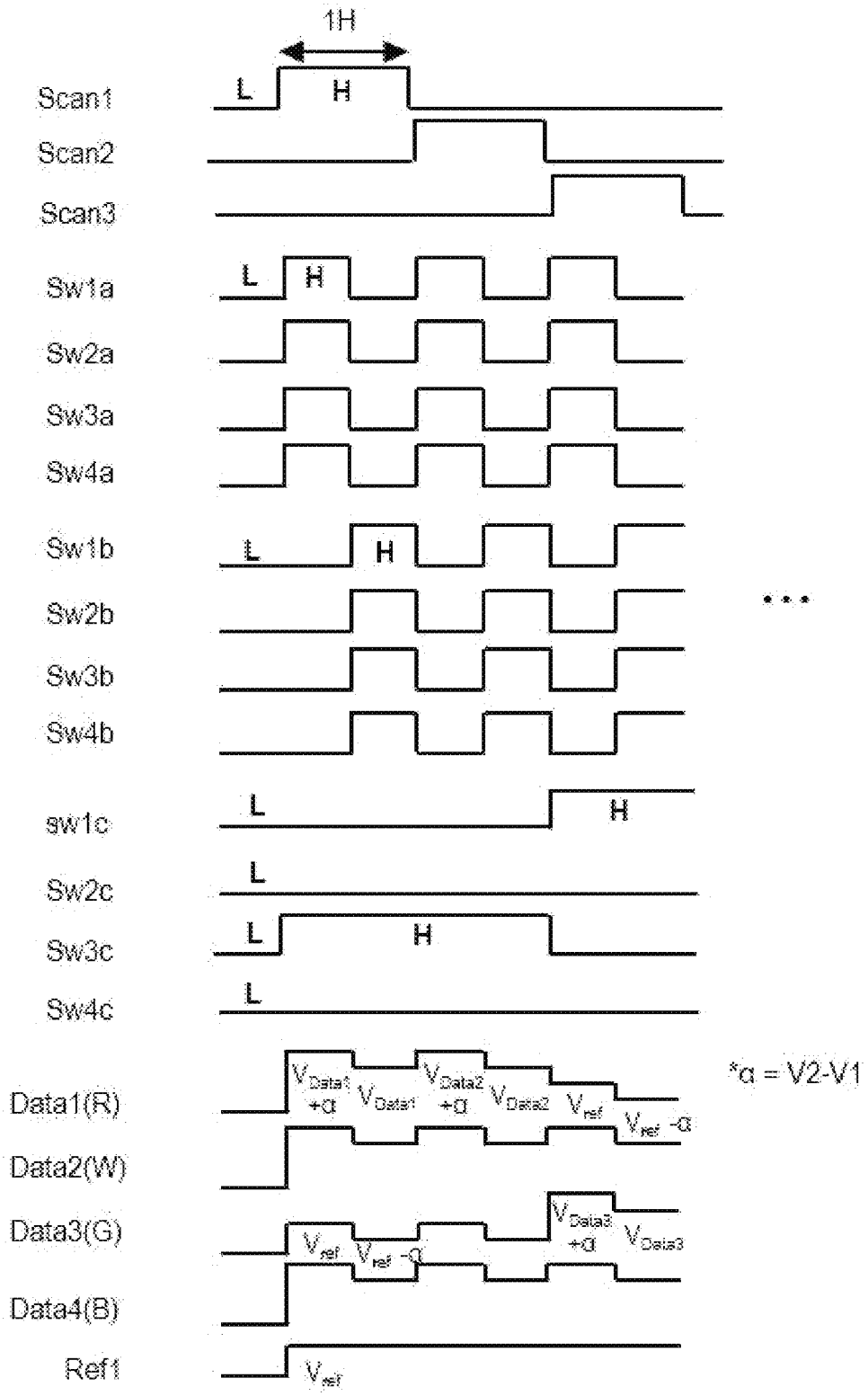
FIG. 24 is a view illustrating a part of a data write period of the LED device of FIG. 22.

FIG. 22 is a circuit diagram of an LED device according to a fourth embodiment of the present invention, FIG. 23 is a detailed diagram of a part of a circuit illustrated in FIG. 22, and FIG. 24 is a view illustrating a part of a data write period of the LED device according to the fourth embodiment of the present invention.

As illustrated in FIGS. 22 and 23, the panel driving circuit of the data driver 140 can include data voltage output units DAC[R], DAC[W], DAC[G], and DAC[B], a first switching group SW1*c* to SW4*c*, a second switching group SW1*a* to SW4*a*, and output circuit units OUC.

The first switching group can include a first-C switch SW1*c*, a second-C switch SW2*c*, a third-C switch SW3*c* and fourth-C switch SW4*c*. The first-C switch to the fourth-C switch SW1*c* to SW4*c* can serve to transmit a black voltage output from one of the data voltage output units DAC[R], DAC[W], DAC[G], and DAC[B] to the first reference line REF1 connected to the first sensing channel SIO1. Accordingly, one of the first-C switch to the fourth-C switch SW1*c* to SW4*c* can be turned on during a data write period of the display panel.

The first-C switch SW has a first electrode connected to the red data voltage output unit DAC[R], a second electrode connected to the first sensing channel SIO1, and a control electrode connected to a first-C control line to which a first-C switch control signal is transmitted. The second-C switch SW2*c* has a first electrode connected to the white data voltage output unit DAC[W], a second electrode connected to the first sensing channel SIO1, and a control electrode connected to a second-C control line to which a second-C switch control signal is transmitted. The third-C switch SW3*c* has a first electrode connected to the green data voltage output unit DAC[G], a second electrode connected to the first sensing channel SIO1, and a control electrode connected to a third-C control line to which a third-C switch control signal is transmitted. The fourth-C switch SW4*c* has a first electrode connected to the blue data voltage output unit DAC[B], a second electrode connected to the first sensing channel SIO1, and a control electrode connected to a fourth-C control line to which a fourth-C switch control signal is transmitted.

The second switching group can include a first-A switch SW1*a*, a second-A switch SW2*a*, a third-A switch SW3*a*, and a fourth-A switch SW4*a*. The first-A switch to the fourth-A switch SW1*a* to SW4*a* can serve to transmit each of data voltages or black voltages output from the data voltage output units DAC[R], DAC[W], DAC[G], and DAC[B] to the output circuit units OUC.

The first-A switch SW1*a* can have a first electrode connected to the red data voltage output unit DAC[R], a second electrode connected to a first electrode of the first-B switch SW1*b* included in the output circuit units OUC, and a control electrode connected to a first-A control line to which a first-A switch control signal is transmitted. The second-A switch SW2*a* can have a first electrode connected to the white data voltage output unit DAC[W], a second electrode connected to a first electrode of the second-B switch SW2*b* included in the output circuit units OUC, and a control electrode connected to a second-A control line to which a second-A switch control signal is transmitted. The third-A switch SW3*a* can have a first electrode connected to the green data voltage output unit DAC[G], a second electrode connected to a first electrode of the third-B switch SW3*b* included in the output circuit units OUC, and a control electrode connected to a third-A control line to which a third-A switch control signal is transmitted. The fourth-A switch SW4*a* can have a first electrode connected to the blue data voltage output unit DAC[B], a second electrode connected to a first electrode of the fourth-B switch SW4*b* included in the output circuit units OUC, and a control electrode connected to a fourth-A control line to which a fourth-A switch control signal is transmitted.

The output circuit units OUC can include amplifiers AMP1, AMP2, AMP3 and AMP4, a third switching group including switches SW1*b*, SW2*b*, SW3*b* and SW4*b*, first voltage output switches SW1*bb*, SW2*bb*, SW3*bb* and SW4*bb* each for outputting a first voltage, second voltage output switches SW1*aa*, SW2*aa*, SW3*aa* and SW4*aa* each for outputting a second voltage, and output capacitors C1, C2, C3 and C4, respectively.

In the output circuit units OUC, the third switching group SW1*b* to SW4*b*, the first voltage output switches SW1*bb* to SW4*bb* each for outputting the first voltage, the second voltage output switches SW1*aa* to SW4*aa* each for outputting the second voltage, and the output capacitors C1 to C4 are circuits disposed at output terminals of the data voltage output units DAC[R], DAC[W], DAC[G], and DAC[B] to alternately output the first voltage and the second voltage having different levels.

The amplifiers AMP1 to AMP4 can include first to fourth amplifiers AMP1 to AMP4. The first to fourth amplifiers AMP1 to AMP4 can serve to amplify the data voltages or the black voltages output through the third switching group SW1*b* to SW4*b* and output the amplified data voltages or black voltages through the first to fourth data channels DCH1 to DCH4, respectively. For reference, the amplifiers AMP1 to AMP4 illustrated in FIG. 22 can be included in the output terminals of the data voltage output units DAC[R], DAC[W], DAC[G], and DAC[B] of the first to third embodiments described above.

The first voltage output switches SW1*bb* to SW4*bb* each for outputting a first voltage can each have a first electrode connected to a first voltage source V1, a second electrode connected to one of the output capacitors C1 to C4, and a control electrode connected to a first voltage output control line. The first voltage output switches SW1*bb* to SW4*bb* can be simultaneously turned on or off in response to first-B, second-B, third-B and fourth-B switch control signals applied through first-B, second-B, third-B and fourth-B control lines. That is, the first voltage output switches SW1*bb* to SW4*bb* can be turned on or off simultaneously with switches included in the third switching group SW1*b* to SW4*b*.

The second voltage output switches SW1*aa* to SW4*aa* each for outputting a second voltage can each have a first electrode connected to a second voltage source V2, a second electrode connected to one of the output capacitors C1 to C4, and a control electrode connected to a second voltage output control line. The second voltage output switches SW1*aa* to SW4*aa* can be simultaneously turned on or off in response to first-A, second-A, third-A and fourth-A switch control signals applied through first-A, second-A, third-A and fourth-A control lines. That is, the second voltage output switches SW1*aa* to SW4*aa* can be turned on or off simultaneously with switches included in the second switching group SW1*a* to SW4*a*. Meanwhile, a level of the second voltage applied to the second voltage source V2 can be higher than a level of the first voltage applied to the first voltage source V1.

One end of each of the first output capacitor to fourth output capacitor C1 to C4 can be connected to each corresponding one of the first voltage output switches SW1*bb* to SW4*bb* and each corresponding one of the second voltage output switches SW1*aa* to SW4*aa*, and the other end thereof can be connected to each corresponding one of the first electrodes of the first-B to fourth-B switches SW1*b* to SW4*b* included in the third switching group SW1*b* to SW4*b*. The first output capacitor to the fourth output capacitor C1 to C4 can serve to be charged with the first voltage, the second voltage, or a difference voltage between the first voltage and the second voltage.

The third switching group SW1*b* to SW4*b* can include the first-B to fourth-B switches SW1*b* to SW4*b*. The first-B to fourth-B switches SW1*b* to SW4*b* can serve to apply the data voltages or black voltages output from the first-A to fourth-A switches SW1*a* to SW4*a* to non-inverting terminals (+) of the first to fourth amplifiers AMP1 to AMP4, respectively. In addition, the first-B to fourth-B switches SW1*b* to SW4*b* can serve to apply the first voltages or second voltages output from the first output capacitor to the fourth output capacitor C1 to C4 to the non-inverting terminals (+) of the first to fourth amplifiers AMP1 to AMP4, respectively.

The first-B switch SW1*b* can have a first electrode connected to the second electrode of the first-A switch SW1*a*, a second electrode connected to the non-inverting terminal (+) of the first amplifier AMP1, and a control electrode connected to a first-B control line to which a first-B switch control signal is applied. The second-B switch SW2*b* can have a first electrode connected to the second electrode of the second-A switch SW2*a*, a second electrode connected to the non-inverting terminal (+) of the second amplifier AMP2, and a control electrode connected to a second-B control line to which a second-B switch control signal is applied. The third-B switch SW3*b* can have a first electrode connected to the second electrode of the third-A switch SW3*a*, a second electrode connected to the non-inverting terminal (+) of the third amplifier AMP3, and a control electrode connected to a third-B control line to which a third-B switch control signal is applied. The fourth-B switch SW4*b* can have a first electrode connected to the second electrode of the fourth-A switch SW4*a*, a second electrode connected to the non-inverting terminal (+) of the fourth amplifier AMP4, and a control electrode connected to a fourth-B control line to which a fourth-B switch control signal is applied.

Hereinafter, a driving method of the fourth embodiment and a part of a device operation according to the driving method will be illustrated and described using an example in which the green data voltage output unit DAC[G] is used as a circuit for outputting a black voltage.

As illustrated in FIGS. 22 to 24, during the data write period of the display panel, the red data voltage output unit DAC[R], the white data voltage output unit DAC[W], and the blue data voltage output unit DAC[B]) can each output a data voltage for expressing a specific gray level. In addition, the green data voltage output unit DAC[G] can output a black voltage for expressing a black gradation.

Meanwhile, FIG. 24 is a timing diagram in which a black voltage is output from the green data voltage output unit DAC[G] when red, white, and blue data voltages are output from the first scan line (scan line to which Scan1 is applied) to the second scan line (scan line to which Scan2 is applied), and a black voltage is output from the red data voltage output unit DAC[R] when red, green, and blue data voltages are output from the third scan line (scan line to which Scan3 is applied) thereafter. However, as in the previous embodiments, the situation where the green sub-pixel SPG and the green data voltage output unit DAC[G] are driven to display only the black gradation without participating in the image display of the display panel will be described as an embodiment.

When the red data voltage output unit DAC[R], the white data voltage output unit DAC[W], and the blue data voltage output unit DAC[B] output data voltages for displaying an image, and the green data voltage output unit DAC[G] outputs a black voltage, the first-C switch SW1*c*, the second-C switch SW2*c*, and the fourth-C switch SW4*c* can be turned off, and the third-C switch SW3*c* can be turned on. Meanwhile, the third-C switch SW3*c* can be turned on only for one horizontal time 1H in which the first scan signal Scan1 is generated as logic high H. However, note that FIG. 24 illustrates that the green data voltage output unit DAC[G] outputs a black voltage for two horizontal times as an example [due to the driving characteristics, the data voltage output unit can output a black voltage, etc. for M horizontal times (M being an integer greater than or equal to 2) instead of one horizontal time 1H, which is similarly applied to the data voltage].

When the data voltage output units DAC[R] to DAC[B] have the above output states, the second switching group SW1*a* to SW4*a*, the second voltage output switches SW1*aa* to SW4*aa*, the third switching group SW1*b* to SW4*b*, and the first voltage output switches SW1*bb* to SW4*bb* can have the following operating states.

The second switching group SW1*a* to SW4*a* and the second voltage output switches SW1*aa* to SW4*aa*, and the third switching group SW1*b* to SW4*b* and the first voltage output switches SW1*bb* to SW4*bb* can be alternately and repeatedly turned on and off. As an example, when the second switching group SW1*a* to SW4*a* and the second voltage output switches SW1*aa* to SW4*aa* are turned on, the third switching group SW1*b* to SW4*b* and the first voltage output switches SW1*bb* to SW4*bb* can be turned off. As an example, when the second switching group SW1*a* to SW4*a* and the second voltage output switches SW1*aa* to SW4*aa* are turned off, the third switching group SW1*b* to SW4*b* and the first voltage output switches SW1*bb* to SW4*bb* can be turned on.

According to the above operation, data voltages prepared by the sums of the data voltages output from the red, white, and blue data voltage output units DAC[R], DAC[W], and DAC[B] and alpha voltages a output from the output circuit units OUC can be formed on the first data line DL1, the second data line DL2, and the fourth data line DL4. In addition, a reference voltage Vref prepared as a black voltage output from the green data voltage output unit DAC[G] can be formed on the first reference line REF1.

Voltages formed on the first data line, the second data line, and the fourth data lines DL1, DL2, and DL4 can be changed by a positive alpha voltage (e.g., +α) or a negative alpha voltage (e.g., −α) since the voltages with which the output capacitors C1 to C4 are charged are affected by the first voltage source V1 and the second voltage source V2. On the other hand, a −alpha reference voltage Vref−α can be formed on the third data line DL3 by the black voltages output from the output circuit units OUC along with the reference voltage Vref by the green data voltage output unit DAC[G].

As can be seen from the voltage formed on the third data line DL3, in the fourth embodiment, the reference voltage Vref−α lower than the reference voltage Vref formed on the first reference line REF1 can be applied without toggling the black voltages output from the data voltage output units DAC[R] to DAC[B]. That is, the fourth embodiment has an advantage in that it is possible to express a black gradation without using a configuration or method for toggling the black voltages output from the data voltage output units DAC[R] to DAC[B].

Figure 25:
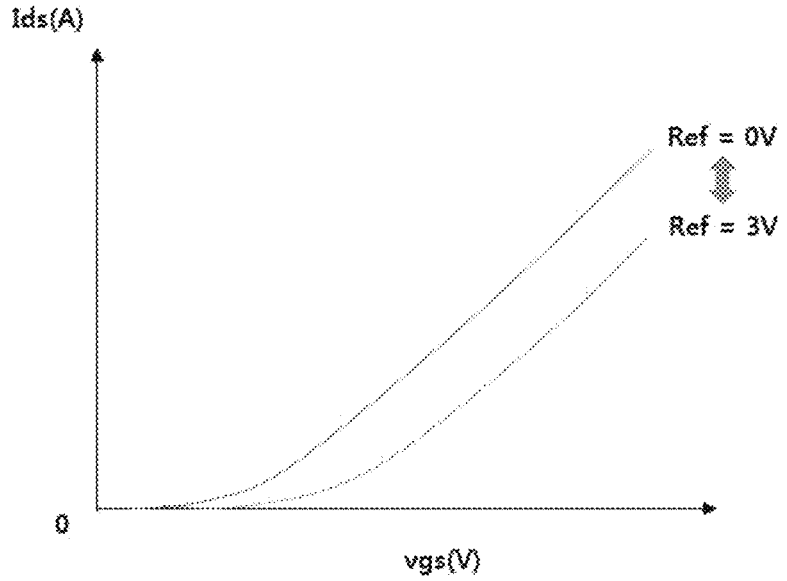
FIG. 25 and FIGS. 26A and 26B are views illustrating effects of embodiments of the present disclosure.
Figure 26A:
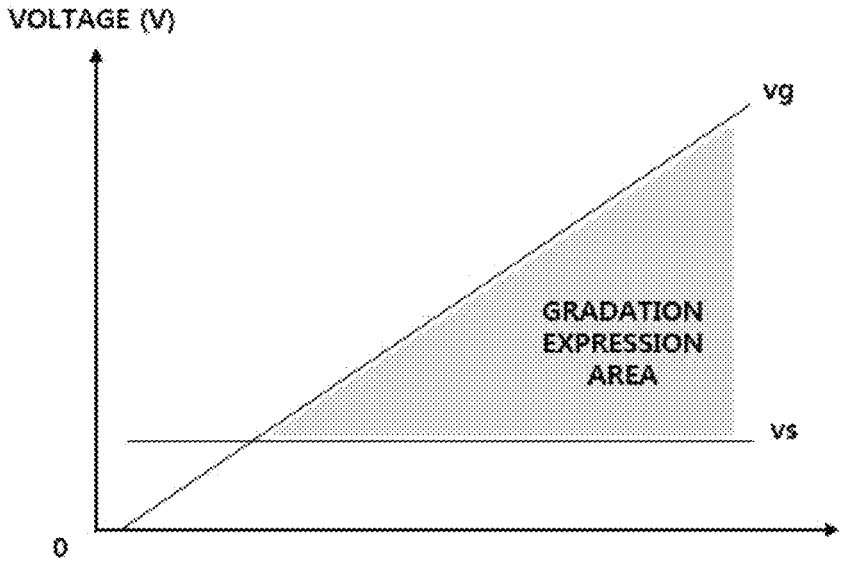
Figure 26B:
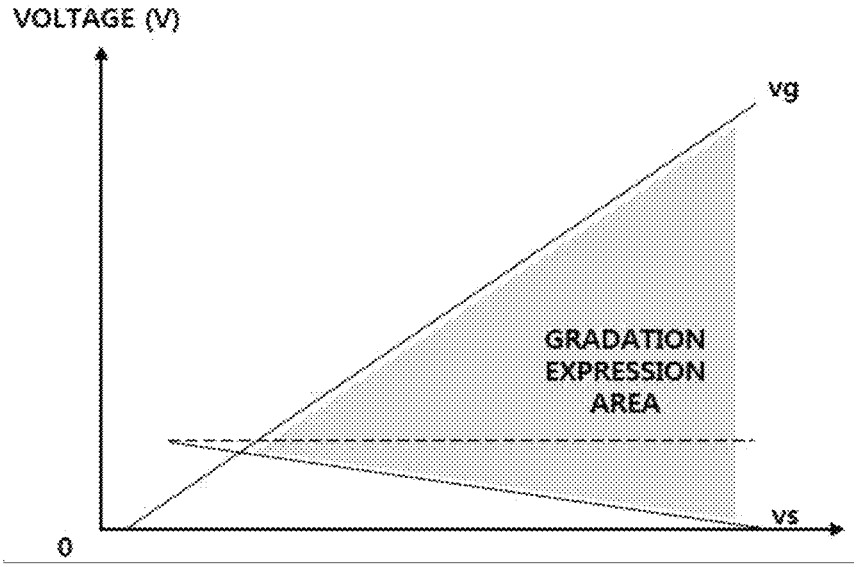

FIG. 25 and FIGS. 26A and 26B are views illustrating effects of the embodiments of the present invention.

As illustrated in FIG. 25, according to the present invention including the first to fourth embodiments described above, since the data voltage output unit capable of changing a voltage is used, it is possible to vary (control) the reference voltage Ref for each single pixel. Meanwhile, even though FIG. 25 illustrates that the reference voltage Ref is varied to 0V to 3V as an example, this is merely an example for better understanding, and the present invention is not limited thereto since the voltage can be selected depending on the state of the element formed on the display panel (deterioration state of the driving transistor, etc.).

As in a conventional example illustrated in FIG. 26A, when a fixed reference voltage is used, a gate voltage vg and a source voltage vs are limited to specific conditions, and thus the gradation expression area can be limited correspondingly.

However, as in the present invention illustrated in FIG. 26B, when a variable reference voltage is used, a source voltage vs can be varied under a specific condition, and thus higher luminance can be expressed by individually varying a voltage applied to a sub-pixel. In addition, even when the same number of bits as that in the related art is used, the gradation expression area can be further expanded. Furthermore, when a circuit capable of varying the reference voltage is provided as in the present invention, a data voltage margin required for external compensation can be calculated for each sub-pixel and applied based on varying the reference voltage applied to that specific sub-pixel.

As described above, the present invention has an effect of expressing higher luminance by individually varying the voltage applied to the sub-pixel. In addition, the present invention has an effect of extending the gradation expression area by controlling not only bits of data but also a reference voltage in units of bits (the same number of bits). In addition, the present invention has an effect that a data voltage margin required for external compensation can be calculated for each pixel and applied. In addition, the present invention has an effect of reducing power consumption due to removal/deletion of a configuration that uses a constant power supply, since the voltage source present in the data driver can be removed during external compensation.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A light emitting display (LED) device, comprising:

a display panel configured to display an image; and a data driver including a panel driving circuit configured to drive the display panel and a panel sensing circuit configured to sense a condition of the display panel, wherein the panel driving circuit includes a first data voltage output circuit configured to output a voltage to a first data line and a first reference line of the display panel to display black on a first sub-pixel included in the display panel.

2. The LED device according to claim 1, wherein the first data voltage output circuit is configured to:

control the first sub-pixel not involved in emitting light for displaying the image among sub-pixels included in the display panel, and output a voltage for displaying black to the first sub-pixel instead of a data voltage used for emitting light to display the image during a data write period of the display panel.

3. The LED device according to claim 2, wherein the voltage for displaying black is varied according to a state of an element included in the display panel.

4. The LED device according to claim 1, wherein the voltage output from the first data voltage output circuit is shared by a switch included in the data driver, the switch being configured to electrically connect the first data line and the first reference line to each other.

5. The LED device according to claim 1, wherein the data driver includes switches configured to electrically connect a sensing channel together with a data channel during a data write period of the display panel.

6. The LED device according to claim 5, wherein the switches include:

a first switching group configured to perform a switching operation to transmit a first voltage output from the data voltage output circuit to the sensing channel; and a second switching group configured to perform a switching operation to output a second voltage output from the data voltage output circuit through the data channel.

7. The LED device according to claim 6, wherein:

the data voltage output circuit alternately outputs the first voltage and the second voltage during the data write period of the display panel, the first voltage having a different voltage level than the second voltage; and at least one switch included in the first switching group transmits the first voltage to the data channel and transmits the second voltage to the sensing channel.

8. The LED device according to claim 5, wherein the data driver further includes an output circuit disposed at an output terminal of the data voltage output circuit to alternately output a first voltage and a second voltage during the data write period of the display panel, the first voltage having a different voltage level than the second voltage.

9. The LED device according to claim 8, wherein the output circuit includes:

an amplifier;

a first voltage output switch configured to output a first voltage from a first voltage source;

a second voltage output switch configured to output a second voltage from a second voltage source;

an output capacitor charged with voltages output through the first voltage output switch and the second voltage output switch; and a third switching group configured to perform a switching operation to apply a voltage, from the output capacitor, to a non-inverting terminal of the amplifier.

10. A driving method of a light emitting display (LED) device including a display panel for displaying an image, and a data driver including a panel driving circuit for driving the display panel and a panel sensing circuit for sensing the display panel, the driving method comprising:

simultaneously applying a voltage to a first data line and a first reference line of the display panel to display black on a first sub-pixel included in the display panel; and applying data voltages to a second data line, a third data line and a fourth data line of the display panel to display an image on a second sub-pixel, a third sub-pixel and a fourth sub-pixel included in the display panel.

11. A light emitting display (LED) device, comprising:

a display panel configured to display an image, the display panel including a first sub-pixel, a second sub-pixel and a third sub-pixel connected in common to a common reference line for sensing a condition of the display panel; and a data driver configured to drive the display panel, the data driver including:

a first switching group including:

a first switch connected between a first data line of the first sub-pixel and the common reference line, a second switch connected between a second data line of the second sub-pixel and the common reference line, and a third switch connected between the third data line of the third sub-pixel and the common reference line, wherein the first switching group is configured to simultaneously supply a black voltage to the common reference line and one of the first, second and third data lines for presenting black.

12. The LED device according to claim 11, wherein the data driver is configured to individually vary a reference voltage supplied to each of the first, second and third sub-pixels.

13. The LED device according to claim 11, wherein the data driver further includes:

first, second and third data voltage output circuits configured to output data voltages to the first, second and third sub-pixels, respectively; and a second switching group including:

a fourth switch connected between the first data voltage output circuit and the first sub-pixel, a fifth switch connected between the second data voltage output circuit and the second sub-pixel, and a sixth switch connected between the third data voltage output circuit and the third sub-pixel.

14. The LED device according to claim 13, wherein the data driver is configured to control the first, second and third switches in the first switching group to operate in an opposite manner relative to the fourth, fifth and six switches in the second switching group.

15. The LED device according to claim 14, wherein the data driver is configured to:

alternately turn on and turn off one of the fourth, fifth and six switches in the second switching group for alternately outputting a first voltage and a second voltage for expressing black to a data line of a specific sub-pixel among the first, second and third sub-pixels, during one data write period of the display panel, while remaining sub-pixels among the first, second and third sub-pixels other than the specific sub-pixel are supplied with data voltages for emitting light for displaying the image.

16. The LED device according to claim 15, wherein the first voltage is 0 volts and the second voltage is 1 volt.

17. The LED device according to claim 13, wherein the data driver further includes:

first, second and third amplifiers connected to the first, second and third data lines, respectively;

a third switching group including:

a seventh switch connected between the first amplifier and the first data voltage output circuit, an eight switch connected between the second amplifier and the second data voltage output circuit, and a ninth switch connected between the third amplifier and the third data voltage output circuit; and a group of output capacitors including:

a first output capacitor having a first electrode connected between an input terminal of the first amplifier and the fifth switch, a second output capacitor having a first electrode connected between an input terminal of the second amplifier and the sixth switch, and a third output capacitor having a first electrode connected between an input terminal of the third amplifier and the seventh switch.

18. The LED device according to claim 17, further comprising:

a fourth switching group including:

a plurality of first output switches configured to supply a first voltage, and a plurality of second output switches configured to supply a second voltage having a different voltage level than the first voltage, wherein a second electrode of each of the first, second and third output capacitors is connected to one of the plurality of first output switches and one of the plurality of second output switches.

19. The LED device according to claim 18, wherein each of the first, second and third output capacitors is configured to be charged to the first voltage, the second voltage and a difference voltage between the first voltage and the second voltage.

20. The LED device according to claim 19, wherein the data driver is configured to adjust voltages formed on the first, second and third data lines based on the first and second voltages supplied to a corresponding one of the first, second and third output capacitors.

* * * * *